US007267224B2

(12) United States Patent
Cuomo

(10) Patent No.: US 7,267,224 B2
(45) Date of Patent: Sep. 11, 2007

(54) CARRIER AND METHOD

(75) Inventor: Angelo V. Cuomo, Staten Island, NY (US)

(73) Assignee: E Z Media, Inc., New York, NY (US)

( * ) Notice: Subject to any disclaimer, the term of this patent is extended or adjusted under 35 U.S.C. 154(b) by 455 days.

(21) Appl. No.: 10/737,612

(22) Filed: Dec. 16, 2003

(65) Prior Publication Data

US 2004/0124107 A1 Jul. 1, 2004

Related U.S. Application Data

(63) Continuation-in-part of application No. 10/213,938, filed on Aug. 6, 2002, now Pat. No. 7,178,283, and a continuation-in-part of application No. 10/662,265, filed on Sep. 15, 2003.

(51) Int. Cl.
*B65D 75/00* (2006.01)

(52) U.S. Cl. ..... 206/175; 206/162; 206/180

(58) Field of Classification Search ..... 206/144, 206/162, 175, 180, 183, 188, 190; 229/117
See application file for complete search history.

(56) References Cited

U.S. PATENT DOCUMENTS

| | | | | |
|---|---|---|---|---|
| 952,302 | A | | 3/1910 | Brenner |
| 962,607 | A | | 6/1910 | Wood |
| 982,919 | A | | 1/1911 | Wood |
| 1,223,202 | A | | 4/1917 | Proctor |
| 2,026,525 | A | | 1/1936 | Korte |
| 2,284,290 | A | | 5/1942 | Marshall, Jr. |
| 2,319,380 | A | | 5/1943 | Wells |
| 2,330,699 | A | | 9/1943 | Flamm |
| 2,339,176 | A | | 1/1944 | Lee |
| 2,373,851 | A | | 4/1945 | Potter |
| 2,405,517 | A | | 8/1946 | Plummer |
| 2,453,908 | A | | 11/1948 | Harhay |
| 2,569,335 | A | * | 9/1951 | Phillips ..... 229/117 |
| 2,594,376 | A | | 4/1952 | Ameson |
| 2,630,264 | A | | 3/1953 | Holy |
| 2,728,484 | A | | 12/1955 | Farrington |
| 2,759,629 | A | | 8/1956 | Sargent |
| 2,828,047 | A | | 3/1958 | Weiselberg |
| 2,850,223 | A | | 9/1958 | Strauss |
| 2,970,740 | A | * | 2/1961 | Fowle et al. ..... 229/117.18 |
| 2,991,908 | A | | 7/1961 | Conescu |
| 3,123,213 | A | | 3/1964 | Kulig |
| 3,140,036 | A | | 7/1964 | Spery |
| 3,158,286 | A | * | 11/1964 | Phillips, Jr. ..... 206/180 |

(Continued)

*Primary Examiner*—David T. Fidei
(74) *Attorney, Agent, or Firm*—Kramer Levin Naftalis & Frankel LLP; Gregor N. Neff

(57) ABSTRACT

The carrier has a folded-panel central vertical support structure with a handle and a pair of trays or receptacles attached to the central support structure, and an optional auxiliary tray with a slotted bottom which can be fitted onto the central support panel. A folded side-wall structure can be unfolded to start the formation of the trays, and a plurality of folded flanges unfold to form a bottom for each receptacle. Dividers separate each receptacle into the three compartments to hold six beverage or other containers in the trays or receptacles. The carriers can be made from a single sheet and advertising printed entirely on one side to facilitate efficient fabrication at a moderate cost.

12 Claims, 15 Drawing Sheets

U.S. PATENT DOCUMENTS 3,225,959 A 12/1965 Jamison
3,266,683 A 8/1966 Ringler
3,547,339 A 12/1970 Bruce
3,565,323 A 2/1971 Katzenmeyer
3,576,274 A 4/1971 Stramaglia
3,661,417 A 5/1972 Inman
3,744,704 A 7/1973 Struble
3,780,906 A 12/1973 Katzenmeyer
3,868,140 A 2/1975 Gordon
3,958,744 A 5/1976 Herglotz
4,007,869 A * 2/1977 Stolkin et al. ..... 229/117
4,047,610 A 9/1977 Stout et al.
4,053,099 A 10/1977 Lock
4,089,457 A 5/1978 Wood et al.
4,155,502 A 5/1979 Forte
4,205,748 A 6/1980 Wilson
4,620,664 A 11/1986 Kaufman et al.
4,744,613 A 5/1988 Brantingham et al.
4,798,285 A 1/1989 Hernandez
4,852,731 A 8/1989 Cooper
4,895,256 A 1/1990 Johnston
4,969,595 A 11/1990 Teasdale
5,042,714 A * 8/1991 Hall ..... 229/117
5,052,552 A 10/1991 Maroszek
5,234,103 A 8/1993 Schuster
5,249,700 A 10/1993 Dumke
5,320,216 A 6/1994 Pangborn
5,332,091 A 7/1994 Gugler
5,337,947 A 8/1994 Eskandry
5,415,277 A 5/1995 Berntsen
5,423,420 A 6/1995 Bakx
D367,409 S 2/1996 Hunter
5,501,338 A 3/1996 Preston
5,524,814 A 6/1996 Davis
5,609,379 A 3/1997 Harrelson
5,611,425 A 3/1997 Holley, Jr.
5,624,024 A 4/1997 Miess
5,645,162 A 7/1997 Harreslon
5,695,051 A 12/1997 Hart
5,709,298 A 1/1998 Harris
5,738,217 A 4/1998 Hunter
5,765,684 A 6/1998 Van Dore et al.
5,788,081 A 8/1998 Bates
5,797,486 A 8/1998 Picciolo
5,803,264 A 9/1998 Gersten et al.
5,813,540 A 9/1998 Vollbrecht et al.
5,816,405 A 10/1998 Carriger, Jr.
5,833,056 A 11/1998 Goldman
5,884,756 A 3/1999 Holley, Jr. et al.
5,927,502 A 7/1999 Hunter
5,927,593 A 7/1999 Berkowitz et al.
5,957,276 A 9/1999 Cutler et al.
5,975,287 A 11/1999 Negelen
6,000,536 A 12/1999 Piotrowski
6,168,013 B1 1/2001 Gomes
D437,222 S * 2/2001 Goldberg ..... D9/432
6,202,836 B1 3/2001 Picciolo
6,230,881 B1 5/2001 Collura
6,341,689 B1 1/2002 Jones
6,443,308 B1 9/2002 Davis
6,598,739 B1 7/2003 Collura
2002/0079237 A1 6/2002 Bakx
2002/0166887 A1 * 11/2002 Matsuoka ..... 229/117
2002/0179459 A1 12/2002 Bakx
2003/0213705 A1 11/2003 Woog

* cited by examiner

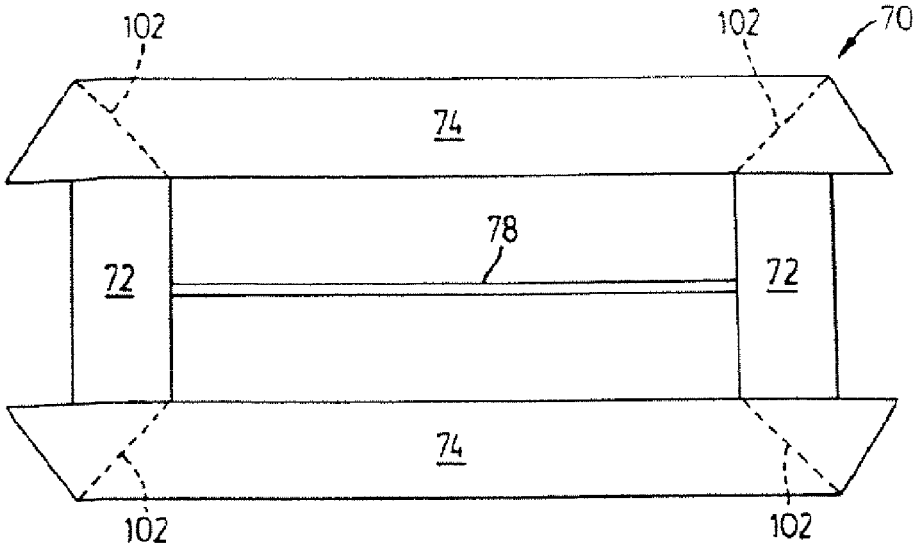
FIG. 6
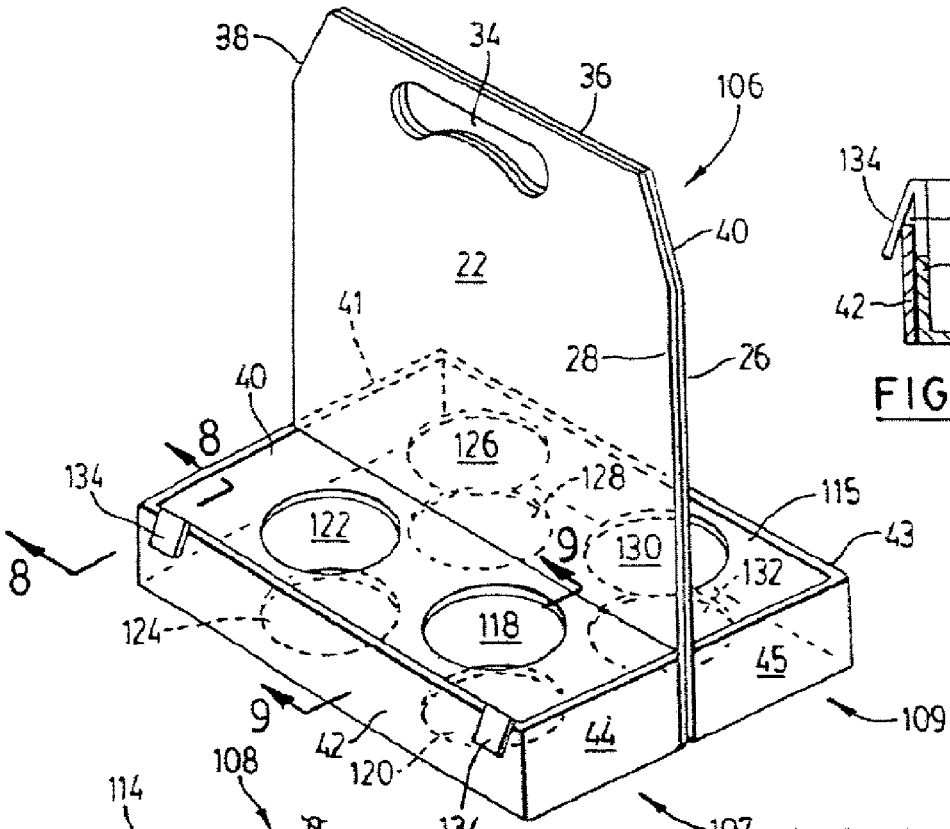
FIG. 7
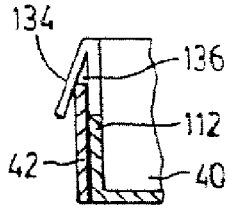
FIG. 8
FIG. 9

FIG. 20.
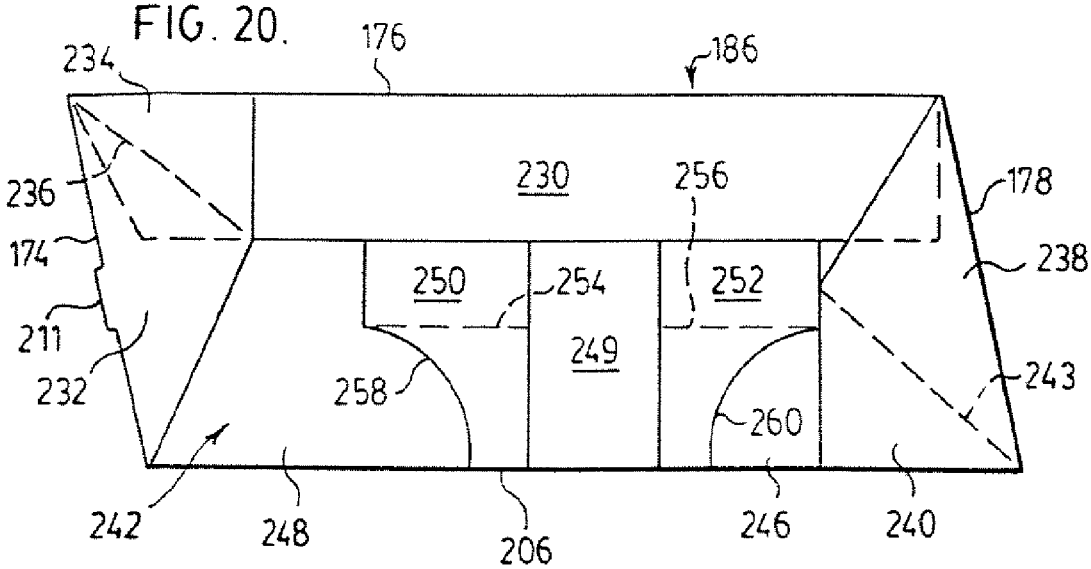
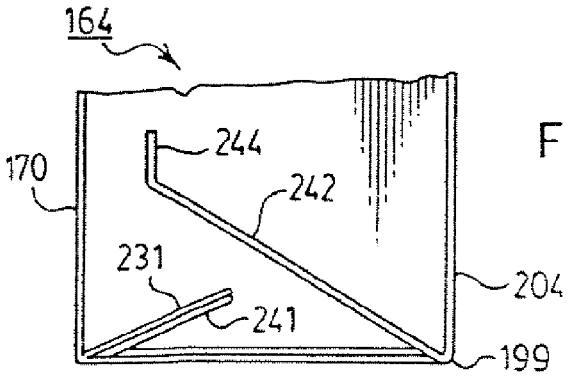
FIG. 21.
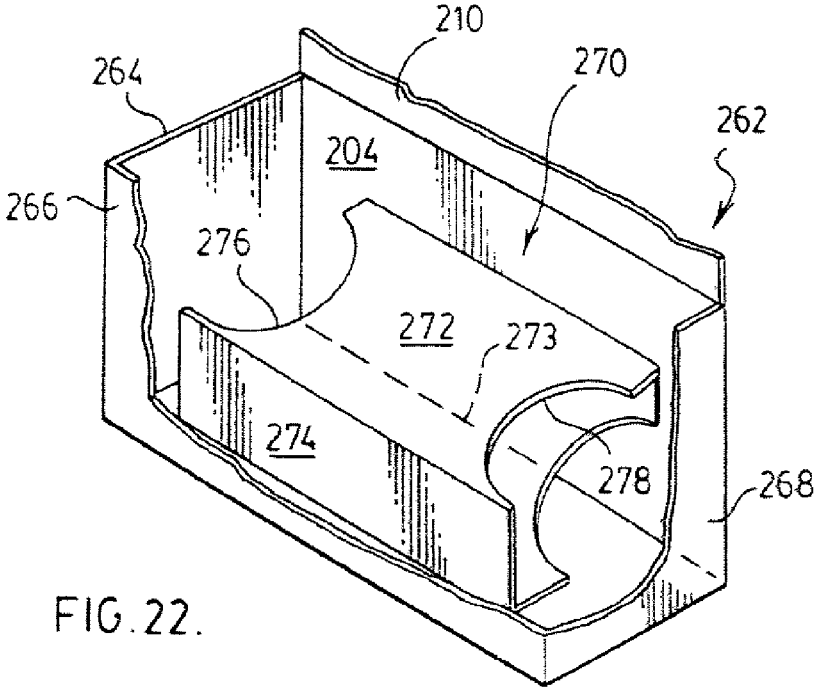
FIG. 22.

FIG. 26.
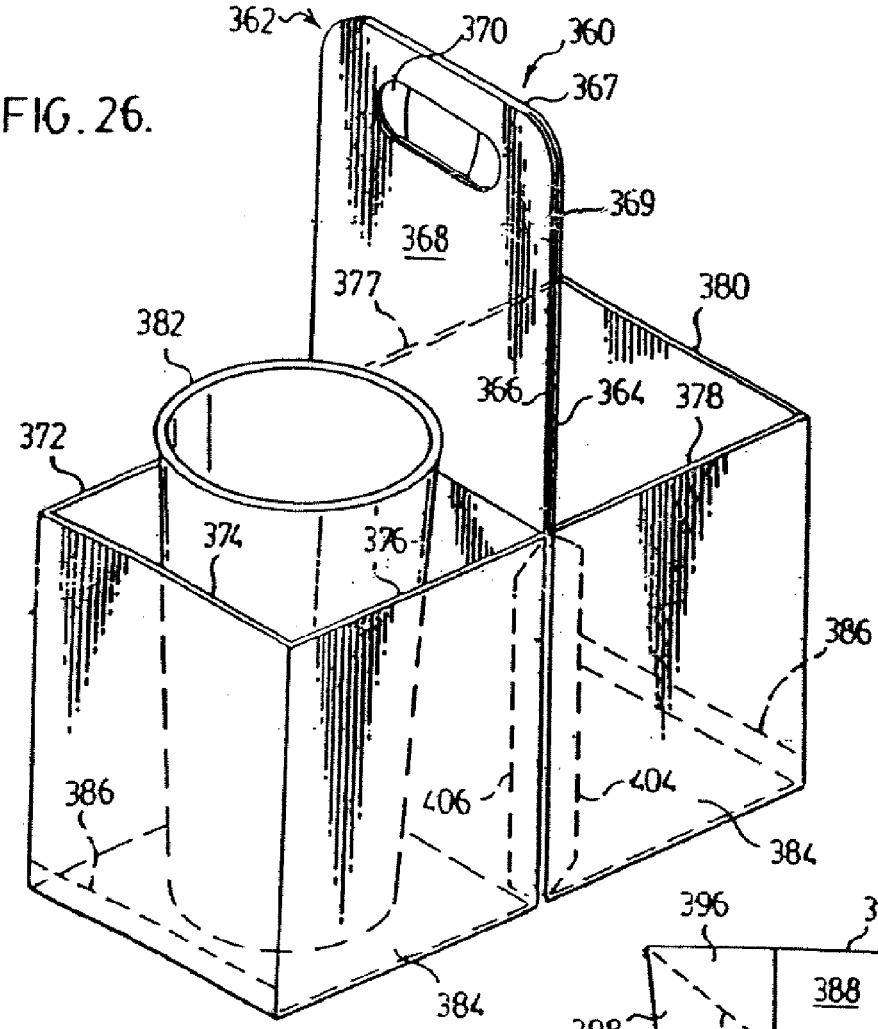
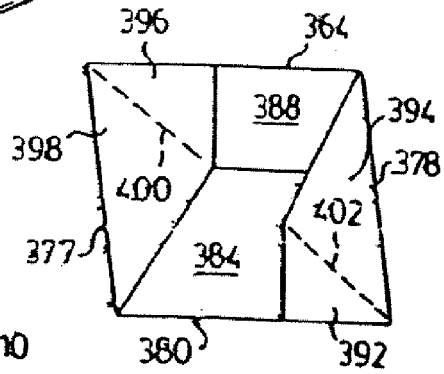
FIG. 27.
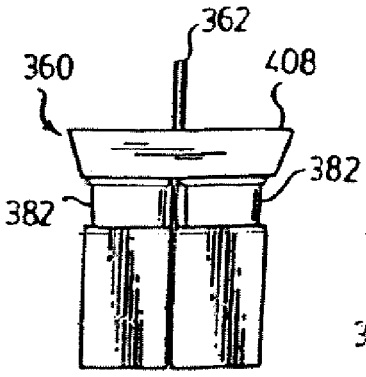
FIG. 28.
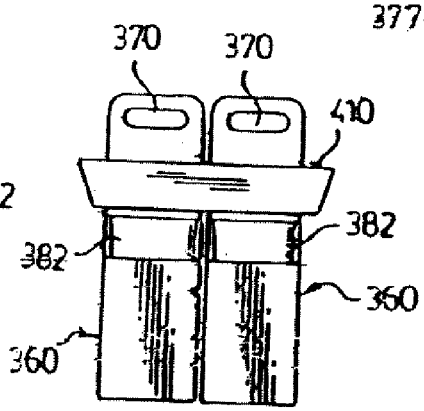
FIG. 29.

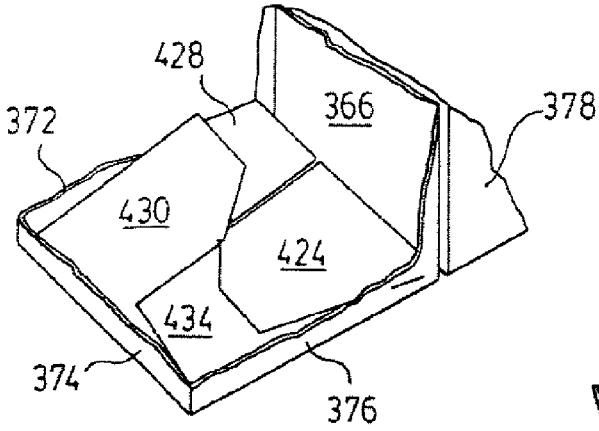
FIG. 32.
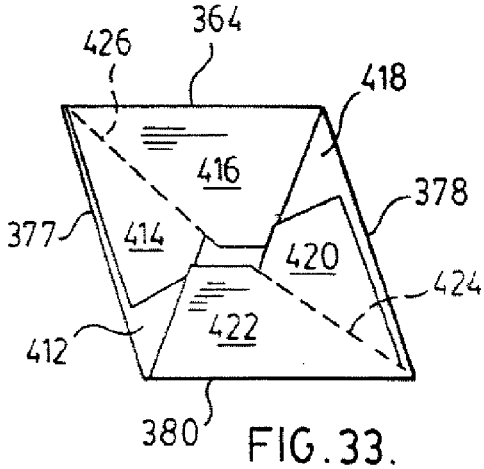
FIG. 33.
FIG. 34
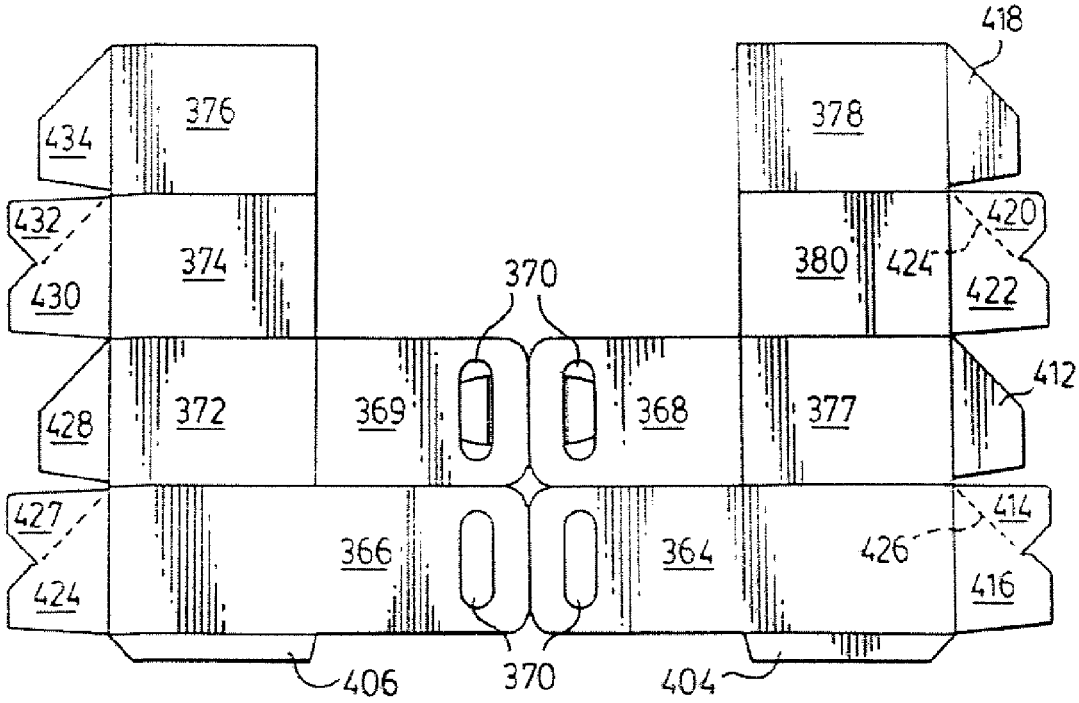

CARRIER AND METHOD

This patent application is a continuation-in-part of U.S. patent application Ser. No. 10/213,938 filed Aug. 6, 2002, now U.S. Pat. No. 7,178,283, and of Ser. No. 10/662,265, filed on Sep. 15, 2003.

This invention relates to carriers, and manufacturing methods, and particularly to hand-held carriers and methods used in carrying and distributing foods, including beverages, and other objects such as cylindrical or other containers, and further relates to advertising means and methods using such carriers and methods.

A problem of long standing is that of distributing food from distribution stands, stores, restaurants, etc., to people to carry to a distant site at which the food is to be eaten. It is difficult for one to carry much more than one or two beverage cups, or one cup and one item of solid food, if only the hands are available for use in carrying the food.

Food carriers are used when more substantial quantities of food must be carried. However, because the carriers must be relatively low in cost, they usually are relatively flimsy and are easily deformed to cause the food to spill from the carrier.

One type of prior carrier has a pair of foldable trays secured to a central support panel with a hand-hold used for carrying the device. The trays have beverage-receiving holes for use in carrying up to four full beverage cups. An auxiliary tray with a long slot in the bottom is fitted onto the central support panel with the panel extending through the slot. The auxiliary tray typically is used for holding solid foods such as hot dogs. The auxiliary tray can rest upon the tops of the beverage containers below it. The carrier thus can be used to carry food and beverages for several people.

The foregoing type of carrier has several disadvantages.

One disadvantage is that several different motions are required in order to unfold the flattened carrier and prepare it for use. This makes the carrier relatively slow and intricate to use.

Another disadvantage is that the container often will not stand up on a horizontal surface by itself. This makes it more difficult and slower to load the food into the carrier.

It has been suggested that such carriers be used to carry advertising for sponsors who supply the carriers. By doing this the relatively higher costs of the carriers are paid by advertisers. Thus, it is desirable to maximize the surface area available for such advertising without excessive increases in cost.

Accordingly, it is an object of the invention to provide a carrier and method which eliminate or alleviate the foregoing disadvantages.

In particular, it is an object of the invention to provide a food and/or beverage carrier which is relatively quick and easy to unfold and set up, and thus speeds the food and beverage distribution process.

It is another object to provide such a carrier which is relatively sturdy and easy to load and unload, thus further speeding and smoothing the distribution of beverages and food.

It is a further object to provide such a carrier with an increased surface area for displaying advertising.

It is an additional object to provide a carrier which is relatively economical to make, and is sturdy and reliable in use.

In accordance with the present invention, the foregoing objects are met by the provision of a carrier having a central support panel with folded receptacles on opposite sides, each of the receptacles consisting of a folded side-wall structure which unfolds to provide a side wall, and a plurality of folded horizontal support panels in the form of flanges which unfold to form a bottom for each receptacle.

In one specific embodiment, the horizontal panel has at least one holding hole for receiving and holding a beverage cup.

Although the specific embodiment described immediately above is good for holding tapered beverage cups whose upper portion will engage with the edge of the hole to hold it in the carrier, another embodiment preferably is used for carrying non-tapered containers, such as cylindrical beverage cans and bottles, and similarly shaped articles. In this embodiment, the trays or receptacles have flat bottoms without holding holes to support the objects. Preferably, the carrier also has retractable side barriers or fixed dividers to support upright containers to sit upright on the flat bottom and prevent the containers from tipping sideways. Thus, in a preferred embodiment, a six-bottle or can carrier is provided.

A holding structure preferably is provided to hold the panels relative to the side wall to support the load to be carried.

In another embodiment, the holding structure includes a tab on one of the parts which engages the other part.

In a further embodiment, the panels or flanges are selectively secured together and folded so as to support the panel structure under a load.

Preferably, the flanges are structured so as to automatically enter the confines of the side wall when the side wall is unfolded so that the carrier is unfolded and set up for use in a single motion.

In another embodiment of the invention, in each receptacle there are two vertically spaced-apart horizontal panels connected to one another, each having at least one beverage-receiving hole aligned with a similar hole in the other panel to support and hold a beverage container.

An optional auxiliary tray is provided. It has a slot in the bottom through which the central panel is inserted. This tray can be used to hold solid food items, with the tray resting on either the tops of beverage containers held in the trays, or on the upper edges of the side-walls.

In another embodiment, the auxiliary tray has the same construction as the main carrier except that it has no beverage cup holes and it has a central recess which fits over the central support panel of the carrier. This auxiliary tray can be used independently as a solid food carrier.

In an embodiment having a flat bottom for supporting cylindrical containers, etc., and which has one or more fixed or retractable side barriers, the barriers serve as dividers to divide each receptacle of the carrier into two o three or more different compartments. One or all compartments can be used to carry beverage cans or bottles, or some compartments for cans or bottles and the others for solid foods or other objects.

The carrier is relatively quick and easy to use in serving foods and beverages. The food server prepares the food to the customer's order. Then, he or she merely unfolds the side-wall structure and places the carrier on a flat surface. Then the server loads the carrier with food and/or beverages. Because the carrier stands erect on its own, the server can use both hands to load the food into the carrier.

A six-pack carrier for beverage or other bottles and cans has two fixed dividers which unfold automatically when the carrier is unfolded.

If the order is only for liquid foods, such as soup or beverages, the beverage-containing cups are inserted into the receiving holes in the trays, or placed on the flat bottom wall of the receptacles, and the carrier is grasped by the handle and carried away by the customer.

If the order also includes solid foods, such as hot dogs, hamburgers, bags of peanuts, potato chips, popcorn, etc., then the auxiliary tray is slipped downwardly onto the central support panel, the sold food is placed in the auxiliary tray, and the customer grasps the handle and carries all of the good items away with one hand.

If the order includes only solid food items, they can be placed in the carrier trays, as long as they are large enough not to pass through the beverage-receiving holes.

In the embodiment having flat bottomed receptacles with optional retractable side barriers, virtually any type of beverage container can be carried, whether tapered cups, cylindrical cans or bottles, or other shapes. Food can be carried side-by-side with beverages by use of the pop-up side barriers to prevent the beverages from tipping over.

Alternatively, or in addition, the solid food items can be carried in one of the auxiliary trays described above.

Food distribution using the carriers of the invention is made faster and easier, both for the servers and the customers, in many different types of events and locations. For example, the carrier can be used to advantage in distributing food from concession stands in baseball, football, tennis and other stadiums; in basketball and other indoor sports arenas; at picnics, indoor and outdoor political and other meetings, and conventions; at self-serve or other carry-out restaurants; at parties and other social gatherings, and at virtually any function or location where food must be carried by the consumer.

Advantageously, the carrier bears the advertisements of one or more sponsors who either supply the carriers for free or defray some of their cost. The advertising can include tear-off coupons good for credit against the purchase of merchandise in order to promote the sale of the merchandise.

Advantageously, the carrier of the present invention has an increased exterior surface area for displaying such advertising.

A notable increase in the available advertising space is created by the construction feature in which the central support panel structure consists of a single panel folded in the middle to form a hinge between the two panels formed by the fold, with a foldable receptacle secured to each of the separate panels. Advertising is printed on the inside facing surfaces of the two panels. A message is displayed on the outside of the carrier advising the user about the interesting materials to be seen by swinging the two halves of the carrier apart.

Advantageously, the carrier can be formed from a single paperboard sheet or blank which can be scored to form separation lines and fold lines. The central support panels, and the foldable receptacle side and bottom walls are all hinged together. The blank advantageously has one surface which is finished and suitable for high quality printing. Preferably, all of the advertising material can be printed on the one surface in one printing operation. Then, the parts are separated along the separation lines, and folded along the fold lines, with selected panels being glued together in selected locations, to form the final folded carrier product.

The foregoing and other objects and advantages of the invention will be apparent from or explained in the following description and drawings.

IN THE DRAWINGS

FIG. 6 is a top plan view of the folded auxiliary tray of the carrier shown in FIG. 1;

FIG. 7 is a perspective view of another embodiment of the carrier of the invention;

FIG. 8 is a cross-sectional, broken away view taken along line 8-8 of FIG. 7;

FIG. 9 is a cross-sectional, broken away view taken along line 9-9 of FIG. 7;

FIG. 20 is a bottom plan view of a portion of the structure of FIG. 16, with one of the receptacles partially folded;

FIG. 21 is a schematic cross-sectional view illustrating structural features of the embodiment shown in FIGS. 16-20;

FIG. 22 is a perspective, broken-away view of an alternative embodiment of the carrier shown in FIGS. 16-21;

FIG. 26 is a perspective view of another embodiment of the present invention;

FIG. 27 is a bottom plan view of the bottom of one of the receptacles of the carrier shown in FIG. 26;

FIG. 28 is a side elevation view of the carrier of FIG. 26 with an auxiliary tray attached;

FIG. 29 is a front elevation view of a pair of the carriers shown in FIG. 26 ganged together by a tray to form an enlarged carrier;

FIG. 32 is a broken-away view of the bottom portion of an alternative bottom construction for the carrier of FIG. 26;

FIG. 33 is a bottom plan view of a partially unfolded bottom section of the carrier illustrated in FIG. 32;

FIG. 34 is a top plan view of a blank used to make the carrier illustrated in FIGS. 32 and 33;

GENERAL DESCRIPTION

Figure 1:
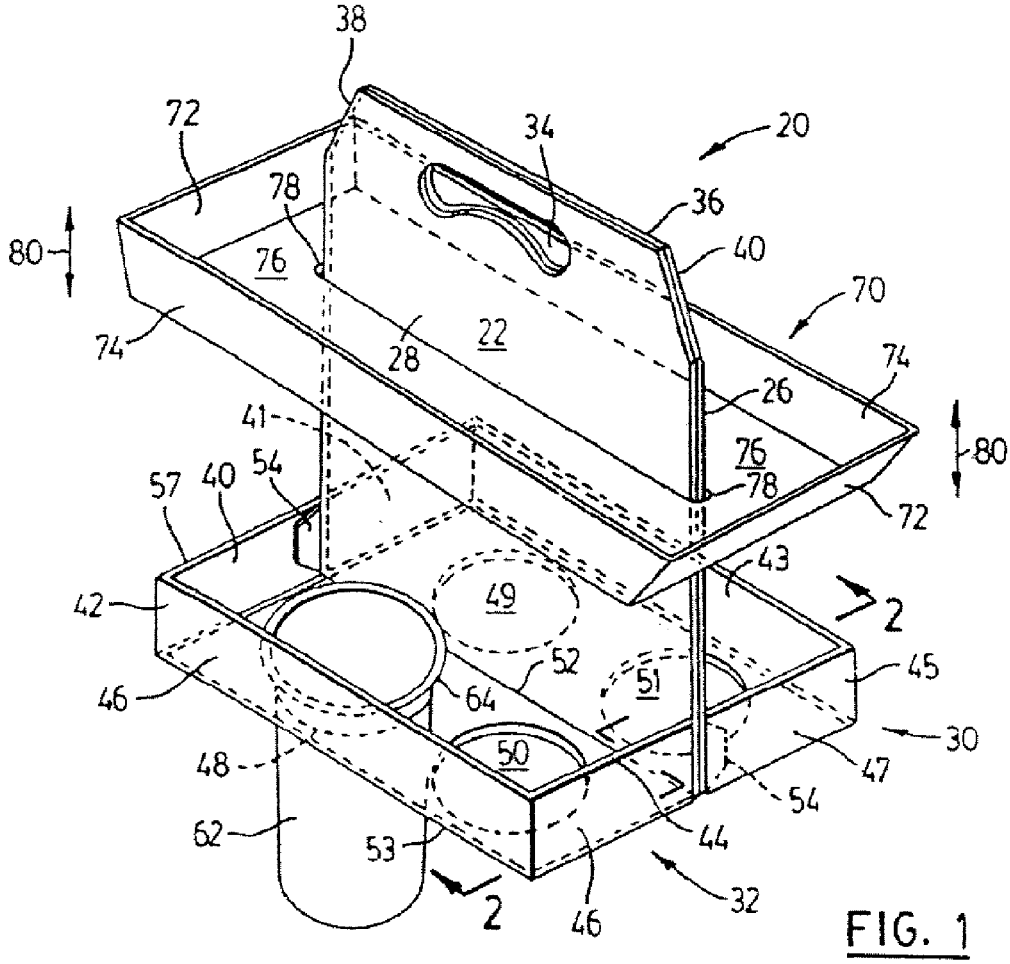
FIG. 1 is a perspective view of one embodiment of the food carrier of the present invention.

Referring first to FIG. 1, the food carrier 20 of the present invention includes a central vertical support panel 22 made of two separate fiberboard panels 26 and 28 adhered together with adhesive to form a laminate.

Extending outwardly from opposite sides of the central panel 22 are two trays 30 and 32 for carrying beverages in up to four cups, such as the cup 62, or solid foods.

Also shown in FIG. 1 is an optional auxiliary tray 70 with side walls 72 and 74 and a bottom wall 76 with an elongated central slot 78.

When the customer orders solid food as well as several beverages, the auxiliary tray 70 is fitted down over the central support panel 22 which extends through the slot 78, and the auxiliary tray 70 slides downwardly until it rests on top of the beverage cups or the upper edges 52 of the trays 30 and 32. A hand-hole 34 is provided in the central support panel 22 and the entire assembly can be carried from a concession stand to the seats in a stadium or the like by using only one hand inserted through the hand-hole 34.

When the customer returns to his or her seat, the customer removes the solid foods from the tray 70, slips the tray 70 off of the central support panel 22, and then removes the beverages from the trays 30 and 32 to distribute to the people for whom the food was ordered.

Advantageously, both the base of the carrier, consisting of the central support panel 22 and the trays 30 and 32, and the auxiliary tray 70 fold flat for compact storage at the concession stand. As it will be explained in greater detail below, the base unit is particularly advantageous in that it can be unfolded very quickly and easily and stands erect on its own so that it can be loaded with beverages very quickly, thus enhancing the efficiency of the food servers using them.

Also in accordance with the present invention, the carrier has an enlarged surface area for the display of advertising by advertisers who buy and supply the carriers to the food vendors or distributors, thus maximizing the advertising value to the advertisers.

Preferred Carrier Base

The preferred carrier base shown in FIG. 1 has a construction which makes the base relatively easy and quick to unfold, and yet enables it to stand erect on a horizontal surface to greatly speed loading food into it.

Figure 2:
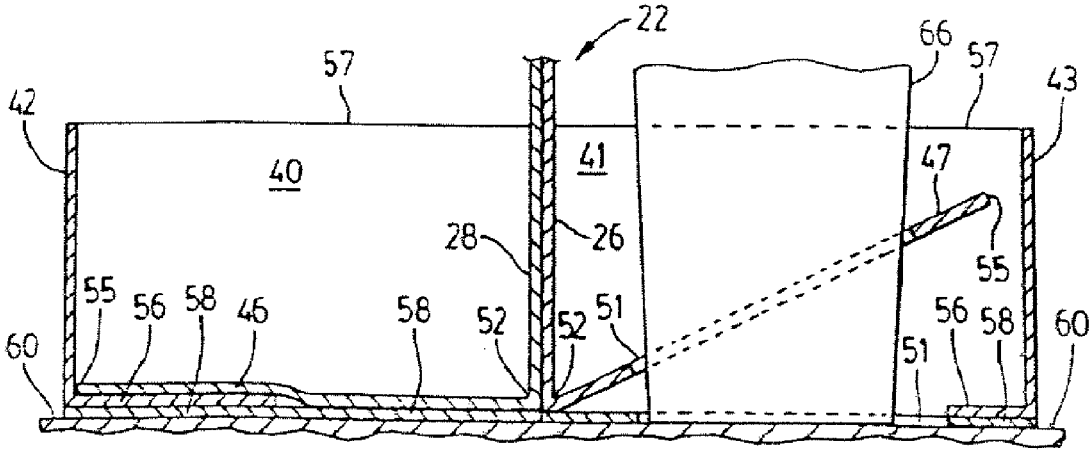
FIG. 2 is a cross-sectional, partially broken-away view taken along line 2-2 of FIG. 1, with modifications to illustrate the operation of the invention.

Referring now to both FIGS. 1 and 2, the tray 32 includes a vertical foldable side wall consisting of sections 40, 42 and 44 which extends from the panel 28 at one end, and is secured at the other end by adhesive to the panel 28 by means of a tab 54 extending outwardly from the panel 28 adjacent its bottom edge.

As it is shown most clearly in FIG. 2, the panel 28 is bent along a fold line 52 to form a horizontal support panel 46 which is shaped and dimensioned so as to fit snugly into the outlines formed by the side wall structure to support the carrier in an erect position when resting on a horizontal surface. The horizontal panel 46 has two relatively large holes 48 and 50 shaped and sized to receive and hold beverage cups, such as the cup 62 which is shown in FIG. 1 fitted into the opening 48.

Typically, the beverage cups are tapered so that they are slightly smaller at the bottom than at the top, and the holes 48 and 50 are dimensioned so as to hold the cup 62 with its upper rim 64 somewhere above the horizontal panel 46, but below the upper edge 57 of the tray 32.

The tray 30 on the other side of the central support panel 22 has a construction which is the mirror image of that shown for the tray 32. Thus, it has a side wall formed of sections 41, 43 and 45, and a horizontal support panel 47 with holes 49 and 51 for receiving beverages. Another tab 54 is used to secure the side wall to the panel 26 with adhesive or the like.

Figure 3:
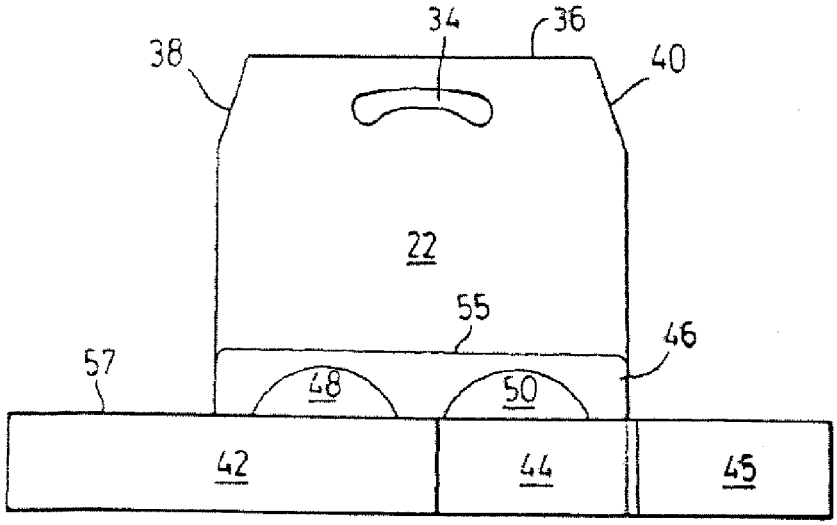
FIG. 3 is a front elevation view of the base portion of the carrier of FIG. 1 folded flat.

FIG. 3 shows the food carrier base of FIG. 1 when folded flat. Both of the side wall structures fold flat, each against its own side, and the horizontal panels 46 and 47 fold upwardly to lie flat against the central support panel 22.

Figure 4:
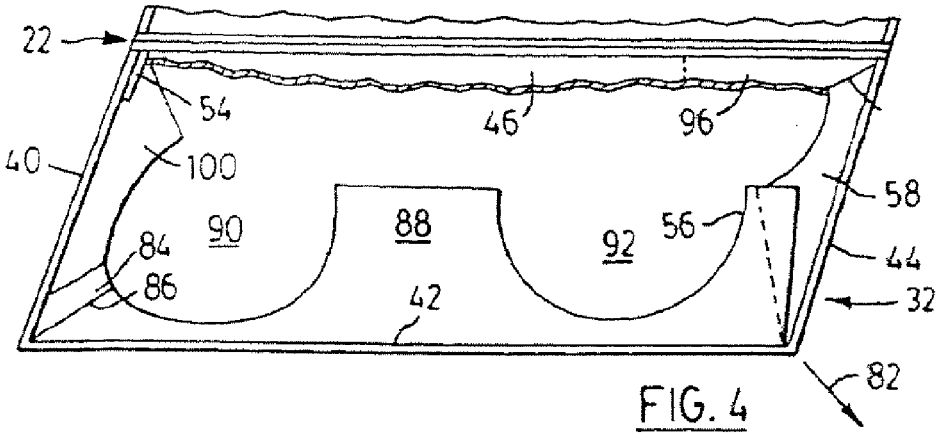
FIG. 4 is a top plan view of a tray of the carrier base shown in FIG. 3, with the tray shown partially unfolded.

When it is desired to unfold the carrier base, the food server merely inserts his or her fingers into the corners of the folded side walls and pulls in the direction indicated by the arrow 82 in FIG. 4, and on the corresponding point in the other tray (not shown in FIG. 4) to unfold the side walls and form the trays 30 and 32.

Figure 5:
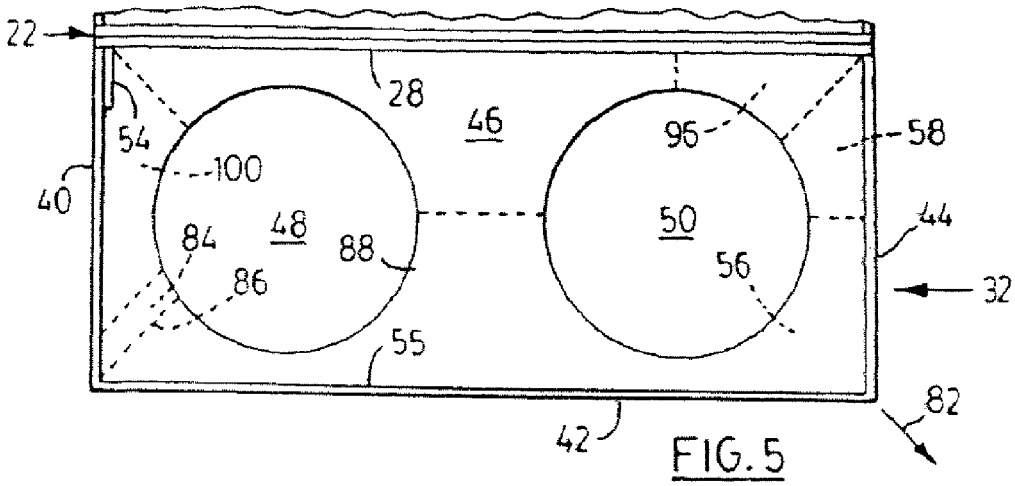
FIG. 5 is a top plan view like that of FIG. 4 with the tray fully unfolded.
Figure 14:
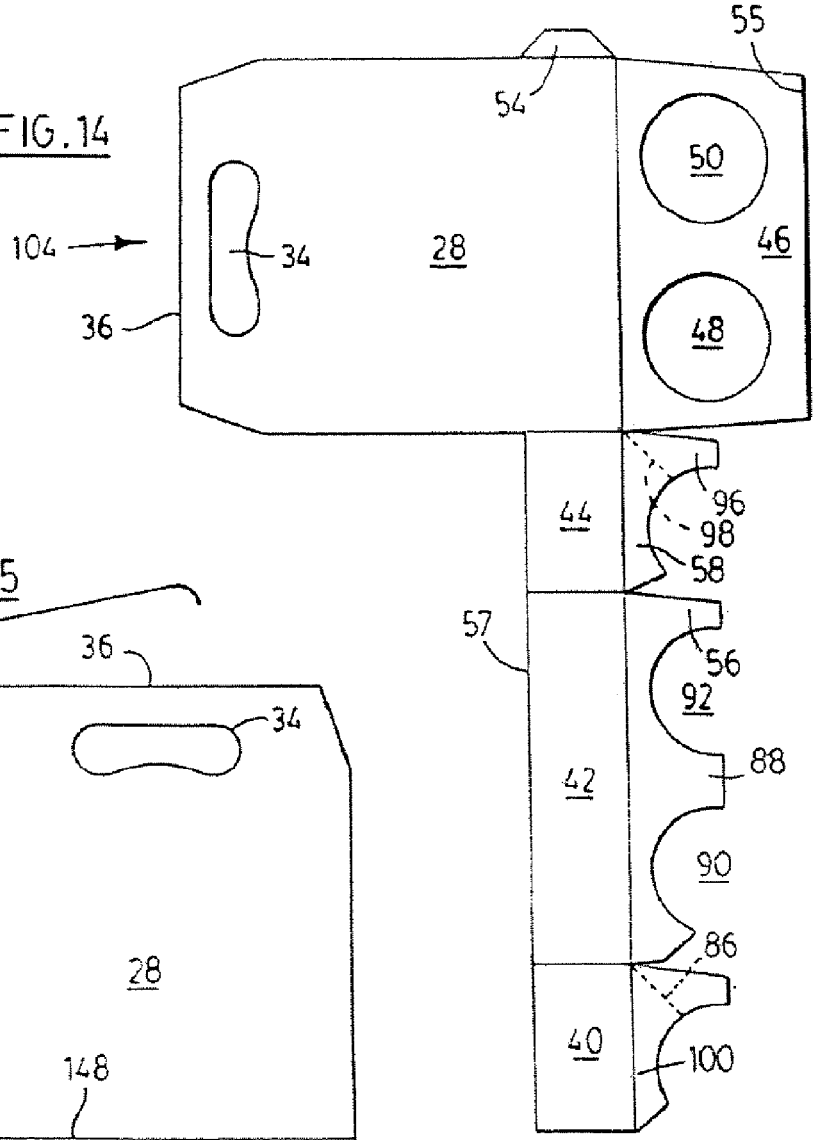
FIG. 14 is a top plan view of the cut form for one half of the carrier base shown in FIG. 1.

Referring now to FIGS. 2, 4, and 5, as well as FIG. 14, extensions 58, projections 56 and 58, 88 and 100 extend inwardly from the bottom edges 53 of the side walls to form a platform upon which the horizontal support panel 46 rests in order to support the relatively heavy weight of multiple large cups filled with beverages.

As it is shown in FIG. 4, the projections are shaped with circular cut-out areas 90 and 92 so as to align with the edges of the holes 48 and 50 when the tray is unfolded.

The projection from the long lateral side 42 has a fold line 86 at one end and a tab 84 which is adhesively attached to the projection 100 extending from the bottom edge of the panel 40.

The projections 56 and 58 are not secured to one another and the projection 56 slides over the top of the projection 58 during unfolding.

The projection 58 from the side wall section 44 has a fold line at 98 and a tab 96 extending underneath the horizontal support panel 46. Preferably, the tab 96 is adhesively secured to the panel 46 so as to provide a means for automatically pulling the panel 46 downwardly into the space between the side walls 40, 42 and 44 as the tray is unfolded.

FIG. 5 shows the tray 32 when it is fully unfolded. The cut outs 90 and 92 align correctly with the holes 48 and 50, and the projections around the periphery provide ample support for the horizontal panel 46.

Referring now to FIG. 2, the outermost edge 55 of each panel 46 and 47 is positioned so that it preferably slightly frictionally engages the side wall 42 or 43 so as to hold it in place once it is fully rotated to its horizontal position. When the trays 30 and 32 are opened in the manner described above, the horizontal support panels 46 and 47 may not be unfolded all the way to the bottom of their respective trays.

Instead, the panel is only partially depressed, to the position of panel 47 shown in FIG. 2. This is not an impediment to fast filling of the carrier, and actually may assist in locating a beverage cup such as the one shown at 66 correctly through the opening 51 in the panel 47 and the bottom of the tray. Then, when the carrier is lifted up, the weight of the full drink cups will pull the panels 46 and 47 downwardly and seat them correctly, without any further effort by the food server.

Thus, a single unfolding motion by the food server is all that is necessary to set up the food tray for loading. The horizontal panels 46 and 47, even when they are in the angular position shown in FIG. 2, hold the side walls to their desired shape so as to hold the entire carrier erect when it is resting on a horizontal surface such as the surface 60 shown in FIG. 2.

FIG. 14 shows the fiberboard form 104 used to form one half of the carrier base. An identical form is provided to form the other half of the base, and the two vertical panels are adhered together with adhesive. The other panel portions are secured together, and the assembled unit is folded flat for shipment to the customer.

FIG. 6 shows the auxiliary tray 70 folded flat along fold lines 102. It is a very simple matter to grasp the end panels 72 and pull them apart to erect the auxiliary panel when it is desired to use an auxiliary panel. Of course, it should be understood that the auxiliary tray 70 also can be used by itself to carry solid foods. Although it usually is too flexible to safely carry beverages, it can be used to carry one or possibly two beverages, but with difficulty. It is far better and safer to use the carrier base to carry beverages.

The carrier base construction makes it strong and easily able to support the heavy weight of multiple full cups of beverages, as well as solid foods piled into the auxiliary tray 70. This is particularly so because of the folding vertical side wall construction with the horizontal support panels which hold the side walls in the desired shape.

Although it is preferred that the carrier base be used for carrying beverages, there is no reason why it cannot also be used to carry solid food items, such as hot dogs and hamburgers, if they are large enough so that they will not fall through the holes in the bottoms of the trays.

Figure 12:
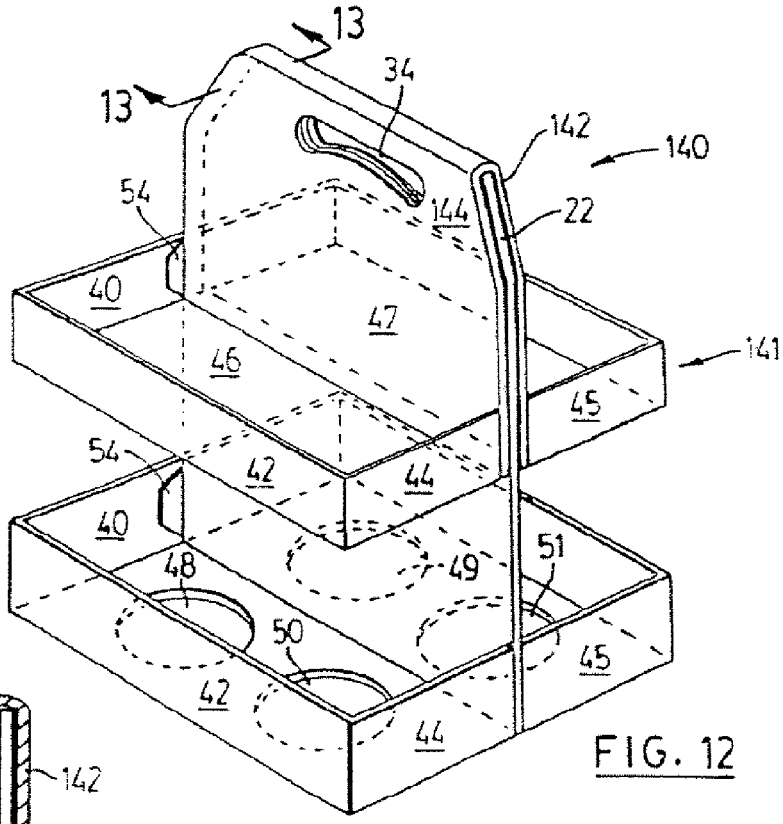
FIG. 12 is a perspective view of another embodiment of the food carrier of the present invention.
Figure 13:
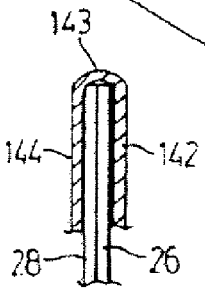
FIG. 13 is a cross-sectional, broken away view taken along line 13-13 of FIG. 12.

In fact, a version of the carrier base shown in FIG. 1 is shown in FIG. 12, without holes in the bottoms of the trays. That version is particularly good for carrying either large or small solid food items. This construction will be described in greater detail below.

Multi-Level Cup Carrier

FIG. 7 shows an alternative embodiment of the base of the carrier of the present invention. The construction of the carrier base 106 shown in FIG. 7 is largely the same as that shown in FIG. 1, and the same reference numerals are used for corresponding elements in both Figures of the drawings.

Two trays 107 and 109 are secured adjacent the bottom edge of the central support panel 22. The tray 107 has a side wall with panels 40, 42 and 44, as described above. Similarly, the tray 109 has a side wall formed of panels 41, 43 and 45, also as described above.

As it is shown in FIG. 9, the tray 107 is formed by the side wall in combination with an extension comprising panels 110, 112, 114 and 116 extending from the bottom of the panel 28 and folded as shown in FIG. 9 to form a rectangular structure 108. The rectangular structure is adhesively secured to the panel 28 by adhesive applied to the end section 116.

An upper opening and a lower opening are provided in order to support each beverage cup. The side support provided by two separate spaced locations bearing upon the sides of the cup helps to increase the stability of the cup as it is being carried.

The folding structure 108 thus described is secured to the side walls by a pair of tabs 134 cut from the material of the panel 112, as shown in FIG. 8, so as to form the tabs. These tabs fit into notches 136 cut into the edges 42 and 43 of the side wall portions of the construction.

Figure 10:
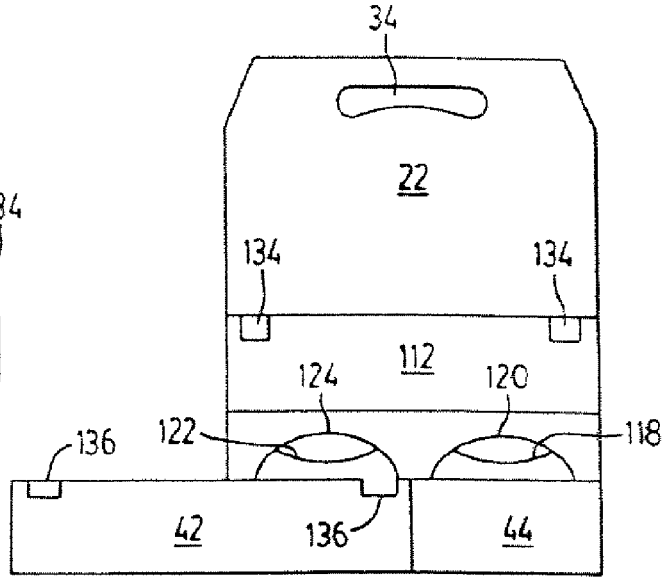
FIG. 10 is a front elevation view of the folded up carrier base which is shown unfolded in FIG. 7.

The carrier base shown in FIG. 7 is shown folded flat in FIG. 10. The structure 108 shown in FIG. 9 is folded upwardly to the position shown in FIG. 10, and the side wall portions are folded to the left, as shown.

Figure 11:
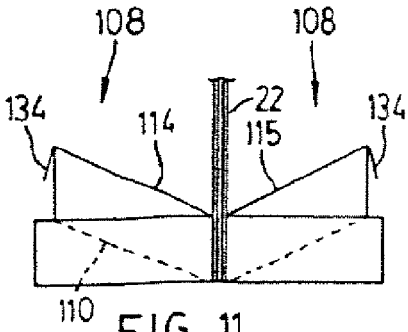
FIG. 11 is a schematic side elevation view of a portion of the base shown in FIGS. 7 and 10 in partially unfolded form.

In unfolding the carrier base, the food server merely pulls on opposite corners of the side walls, as in the FIG. 1 embodiment, and the springiness of the fiberboard causes the structures 108 to rotate partially downwardly to the position shown in FIG. 11, thus causing the side walls to hold a rectangular shape and support the carrier base in an upright erect position to facilitate the loading of the carrier.

The extra openings 118, 122, 126 and 130 formed in the upper wall of each tray helps to stabilize the beverage containers when they are resting on a horizontal surface waiting for the carrier to be lifted upwardly.

When the carrier is lifted upwardly, the weight of the beverage cups pulls the structures 108 downwardly and causes the extending tabs 134 to be seated in the notches 136 in the side wall portions 42 and 43 so as to lock the cup holding portions 108 to the side walls to form a strong and sturdy carrier.

Alternatively, instead of the tabs 134 and notches 136, folding projections such as projections 56, 58, 80, 88 and 100 shown in FIGS. 2-5 can be used as shown in the embodiment of FIG. 1 to support the structures 108 from the bottom.

Although it is not shown in FIG. 7, it should be understood that an auxiliary tray 70, such as that shown in FIGS. 1 and 6, also can be used with the carrier base shown in FIG. 7, in the manner described above with respect to the FIG. 1 structure.

Figure 15:
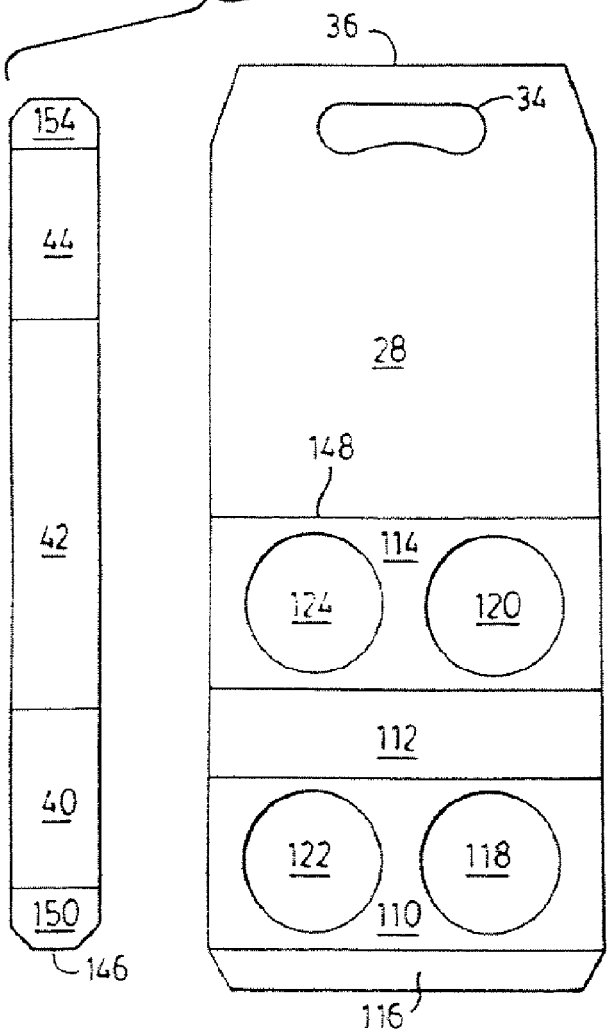
FIG. 15 is a top plan view of the cut form for one half of the carrier base shown in FIG. 12.

FIG. 15 shows the unfolded parts used to form the carrier base shown in FIG. 7. Again, the parts necessary to make only one half of the carrier base are shown, and identical parts would be used to form the other half.

The side wall portion is formed by a strip 146 which is separate from the remainder of the structure, although it could be formed as an integral extension of that structure in the manner of the embodiment shown in FIG. 14, if desired.

The strip 146 has end portions 150 and 154 which are secured to the panel 28 adjacent its bottom edge at the fold line 148.

Piggyback Carrier

FIG. 12 is a perspective view of another food carrier 140 of the present invention. This carrier consists of a base portion which is the same as the base portion shown in either FIG. 1 or FIG. 7, together with an auxiliary tray 141 which is almost identical in construction to the base portion of the unit shown in FIG. 1, except that there are no cup-receiving holes in the horizontal support panels 46 and 47.

Additionally, the two halves of the auxiliary carrier 141 are formed from a single blank or two separate parts are secured together at the top edges 143, so that two panels 142 and 144 are draped over the top edge of the central support panel 22. The panels 142 and 144 have holes 34 positioned to be aligned with the hole 34 in the base unit so that a unitary hand-hole 34 is formed for the combined carrier.

The two panels 142 and 144 are not secured together except at the top edges 143 so that the central support panel 22 of the base unit can fit readily into the opening between the panels 142 and 144.

Thus, the auxiliary carrier 141 rides "piggyback" on the base unit.

The auxiliary carrier 141 has separate utility. When a customer orders only solid foods, or whenever the lack of beverage-receiving holes is not a detriment, the carrier 141 can be used alone. Thus, improved carrying of solid foods as well as liquids is provided. Alternatively, the auxiliary carrier 141 can have beverage-cup receiving holes so as to provide extra beverage carrying capacity.

The height of the auxiliary unit 141 should be selected so that it allows ample room for the cups held in the cup receptacle openings in the base unit to extend a reasonable distance above the bottom of the base unit.

Flat or "Solid"-Bottom Carrier

FIGS. 16 through 23 illustrate flat or "solid"-bottom embodiments of the carriers of the present invention.

Figure 16:
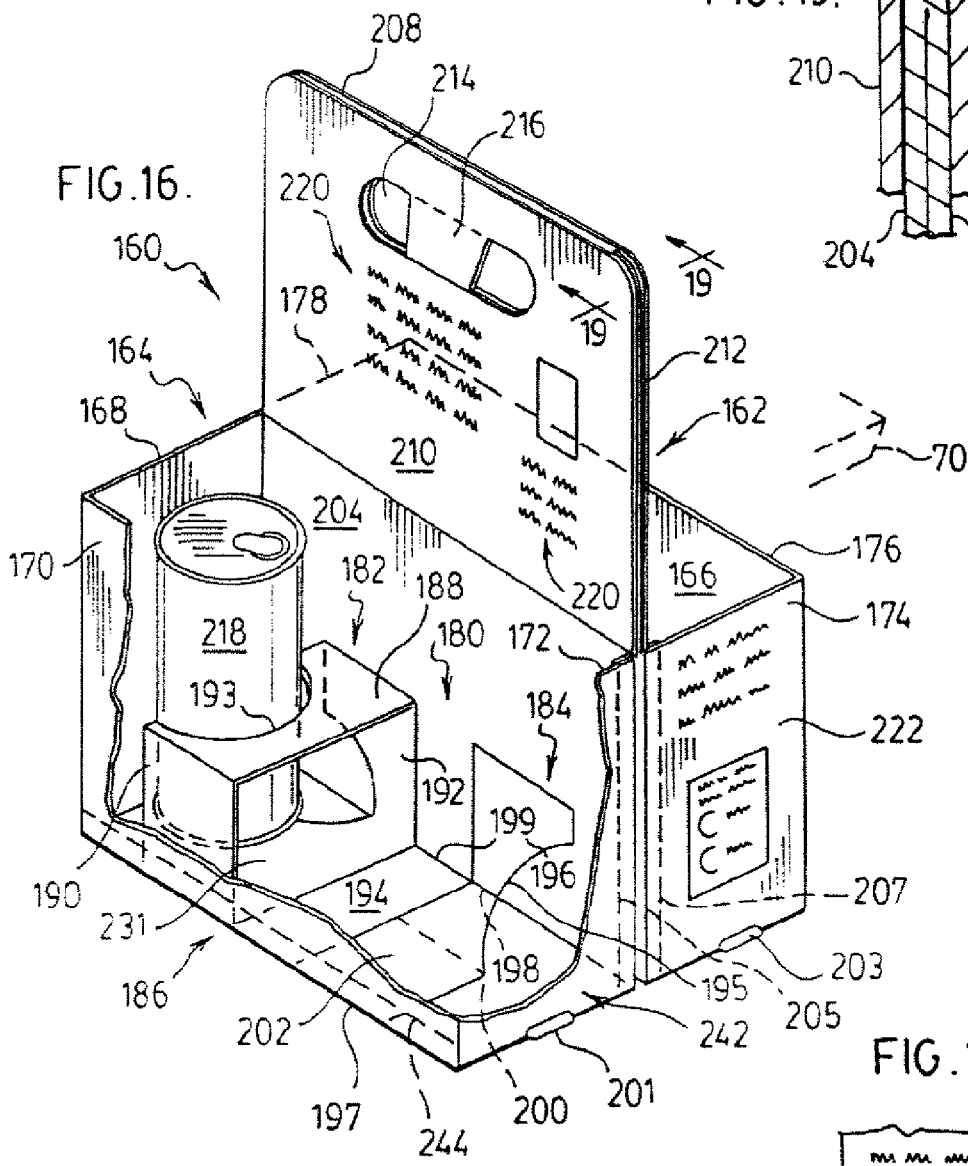
FIG. 16 is a perspective, partially cut-away and partially schematic view of another embodiment of the carrier of the present invention.
Figure 19:
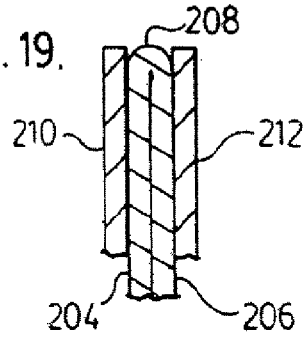
FIG. 19 is a cross-sectional, partially broken-away view taken along line 19-19 of FIG. 16.

Referring to FIG. 16, the carrier 160 shown there has a vertical central support panel structure 162 and two fold-out flat or "solid"-bottom receptacles 164 and 166 which are shown in their unfolded positions. As with the other embodiments of the invention described above, the receptacles 164 and 166 fold flat against the central panel structure 162 to minimize storage volume.

A hand hole is provided at 214 with foldable tabs 216 extending into the hole. When the tabs 216 are folded over by the insertion of a hand into the hole, they partially cover the upper edges of the hole so as to provide a smoother, broader surface to make the carrier more comfortable to carry.

An auxiliary slotted bottom tray, indicated in dashed lines schematically at 70 in FIG. 16, also can be used to hold additional items, in the manner described above in connection with the other embodiments of the invention.

The receptacles 164 and 166 differ from those shown above in FIGS. 1-15 in that the bottom of each receptacle is flat and "solid"; that is, it has a bottom panel structure which is flat and, in one form, is without large holes, and on which containers or other objects can rest, such as the cylindrical beverage container can 218 shown in FIG. 16. Such containers, being cylindrical, are not tapered and will not jam themselves into holes in the bottom of the receptacles like the other embodiments described above. Thus the carrier 160 can be used to carry cylindrical or other-shaped containers, as well as tapered containers, as it will be described more fully below.

Each of the receptacles has a folding side wall structure including three side walls. Receptacle 164 has side walls 168, 170 and 172, and receptacle 166 has side walls 174, 176 and 178. The end of side wall 172 is glued to the edge of a flap 205 extending from the edge of panel 204, and the end of side wall 174 is glued to another flap 207 extending from the edge of panel 206 (also see FIG. 23).

In addition, tabs 201 and 203 (see FIG. 16 as well as FIG. 23), are provided. Those tabs fit into corresponding slots 209, 211 (FIG. 23) near the bottom edges of the panels 172, and 174 when the receptacles are formed by the user, so as to hold each transverse panel 242 down when it is inserted into the side wall structure. By this means, the transverse panel holds the side wall structure in a rectangular shape and allows the carrier to sit upright on a horizontal surface, ready for having objects loaded into the receptacles easily and quickly.

The central support panel structure 162 actually consists of a single panel having two sections 204 and 206 (see FIG. 19) folded at the top edge 208 of the carrier to form a hinge. Additional thicknesses of paperboard 210 and 212 are folded over onto the surfaces 204 and 206, respectively, in the upper half of those panels to reinforce the panel structure 162, and to provide a conveniently printable advertising display surface for both upper halves of the panel structure 162.

The solid bottom structure includes a transverse support panel 242 (see FIG. 21) with a folded side extension 244, and a holding structure 186 (see FIG. 20) to support the transverse support panel 242. The transverse panel 242 is formed as an extension of one of the panels 204 at the bottom end, and is hinged at 199 (see FIG. 16) to the bottom edge of the panel 204. A detailed description of these structures will be set forth below.

Pop-Up Side Barriers

Referring now to FIG. 16, in each of the receptacles is a divider structure generally indicated at 180, which, in the embodiment shown in FIG. 16, includes a pair of pop-up or retractable side-barriers 182 and 184.

The pop-up side barriers 182 and 184 are formed as cutouts from the bottom portion of the panel 204 and of the transverse panel 242.

The structure 182 is shown in the "up" position to form a side-barrier to hold an object 218 such as a beverage can or bottle or cup in the compartment formed by the side barrier to prevent the object 218 from tipping over in the carrier.

The other side barrier structure 184 is shown in the "down" position, i.e., folded flat so as to permit solid food or other objects to be carried in the second compartment of the receptacle 164.

It should be understood that the structures of the bottom and pop-up barriers also are provided in the receptacle 166, but are not shown in the drawings completely in order to avoid redundancy.

The pop-up barrier structure 184 includes a first panel 196 hinged at its top edge to the panel 204, having a fold line at 198, and a semicircular cutout 195 to conform to the surface of a cylinder when it is popped up into barrier-forming position.

The structure 184 also has a portion 202 joined to the panel 196 at a fold line 200, and to the transverse panel at 197.

The structure 182 leaves a cutout hole 192 in the lower portion of the panel 204 when it is raised, and has a section 190 and a fold line 193 which allows it to be pulled or pushed upwardly through the hole in the bottom to the position shown in FIG. 16.

Thus, when the carrier 160 is used, either one of the side barrier structures 182 and 184 may be raised to its upright position to form a cylindrical object-holding compartment. The other side barrier structure can be left unfolded as shown in FIG. 16, so as to provide a compartment without a large opening in the bottom to better enable it to carry solid objects such as hamburgers, hot dogs, popcorn, peanuts, potato chips, etc., or any other object fitting into the compartment, including relatively smaller items.

If desired, both side barriers 182 and 184 can be left unfolded so as to give a completely "solid" support bottom to hold objects in the receptacle. For example, if three beverage cans will fit side-by-side in the receptacle, they can be placed in the receptacle without raising the side barriers and they will support each other and prevent the others from toppling over.

Advertising Space

Virtually all of the side walls and exterior panels of the carrier preferably bear advertising, since it is advertising which facilitates the provision of the carrier to the consumer at no cost, and at a moderate cost or no cost to the food purveyor. For example, advertising appears at 220 on the upper panel 210, on the sides such as at 222 and 224 (also see FIG. 17).

Figure 17:
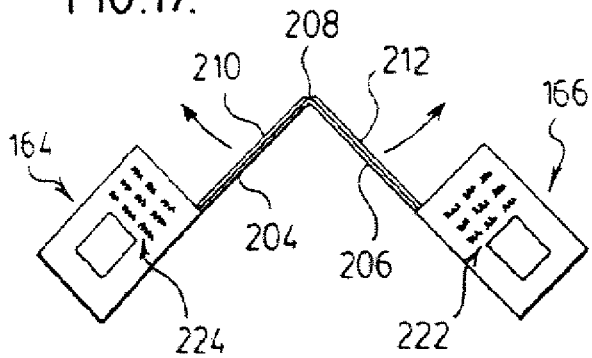
FIG. 17 is a schematic view illustrating one manner of using the carrier of FIG. 16.

In addition, advertising space advantageously is provided on the interior facing surfaces of the panels 204 and 206. This advertising is accessed by merely swinging the two panels 204 and 206 apart at the hinge 208, as illustrated in FIG. 17, to expose the interior surfaces of the panels as shown in FIG. 18.

Figure 18:
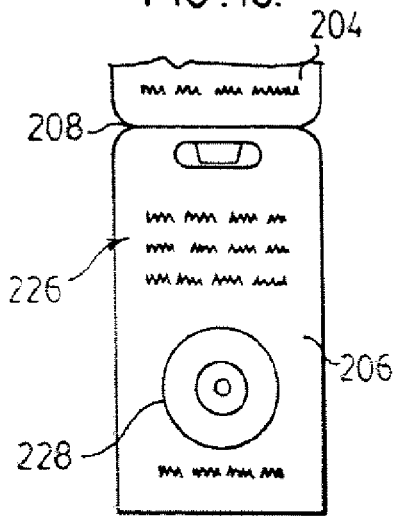
FIG. 18 is a rear elevation view of the inside surfaces of the structure shown in FIGS. 16 and 17.

The surface 206 shown in FIG. 18 carries advertising 226. Advantageously, a CD record 228 is attached to the panel 206, as a free gift to the consumer. It carries any desirable subject matter, such as recorded music, and, if desired, a commercial for the sponsor's product.

Preferably, on the outside surface of the carrier 160, a legend appears informing the user of the advertising and gifts appearing on the inside panels so as to urge the user to spread the panels apart to see what is there.

By this means, the effective advertising surface area of the carrier has been greatly augmented, at minimal cost.

It should be noted that the central panel structure 162 having two panels hinged along their upper edges is a construction which is usable with each of the different embodiments of the invention shown in this patent application. In fact, the upper tray 141 of the embodiment shown in FIG. 12 actually has this hinged construction. Thus, advertising can be printed on each of the interior facing surfaces of the central panel structure, with the increase in advertising space noted above.

Holding Panel Structure

FIG. 20 shows the holding panel structure 186 of the bottom of the receptacle 166.

The bottom edge of the side panel 176 is folded over to form the broad long flap 230 to act as part of the holding panel structure. A corner area 240 of a first corner piece 238 is secured to a portion 246 of the bottom of the panel 242 with adhesive. A fold line is formed at 243. The corner piece 238 is formed as an extension of the lower edge of the side wall 178. (Also see FIG. 23.)

Another corner piece 232 has a corner portion 234 secured to the flap 230 by means of adhesive. A fold line is provided at 236. The flap 232 is formed as an extension of the lower edge of the side wall 174. (See FIG. 23.)

It should be understood that the bottom structure shown in FIG. 20 has a trapezoidal shape rather than a rectangular shape because it is shown partially folded, with the portions 246 and 248 of the bottom panels 243 and 236 partially folded inwardly, in the general position shown in FIG. 21, and the corner pieces folded partially along the lines 242.

The corner pieces provide linkages which help to pull the panel 242 downwardly when the side walls are unfolded, and to strengthen the holding structure and the bottom of the receptacle.

The pop-up barriers for the receptacle 166 are shown, in part, at 250 and 252, with fold lines 254 and 256, semi-circular cut-out edges 258 and 260, and the area 249 of panel 242 between the barrier structures. All of these parts are shown in their folded up position so they form part of a "solid" bottom.

Figure 23:
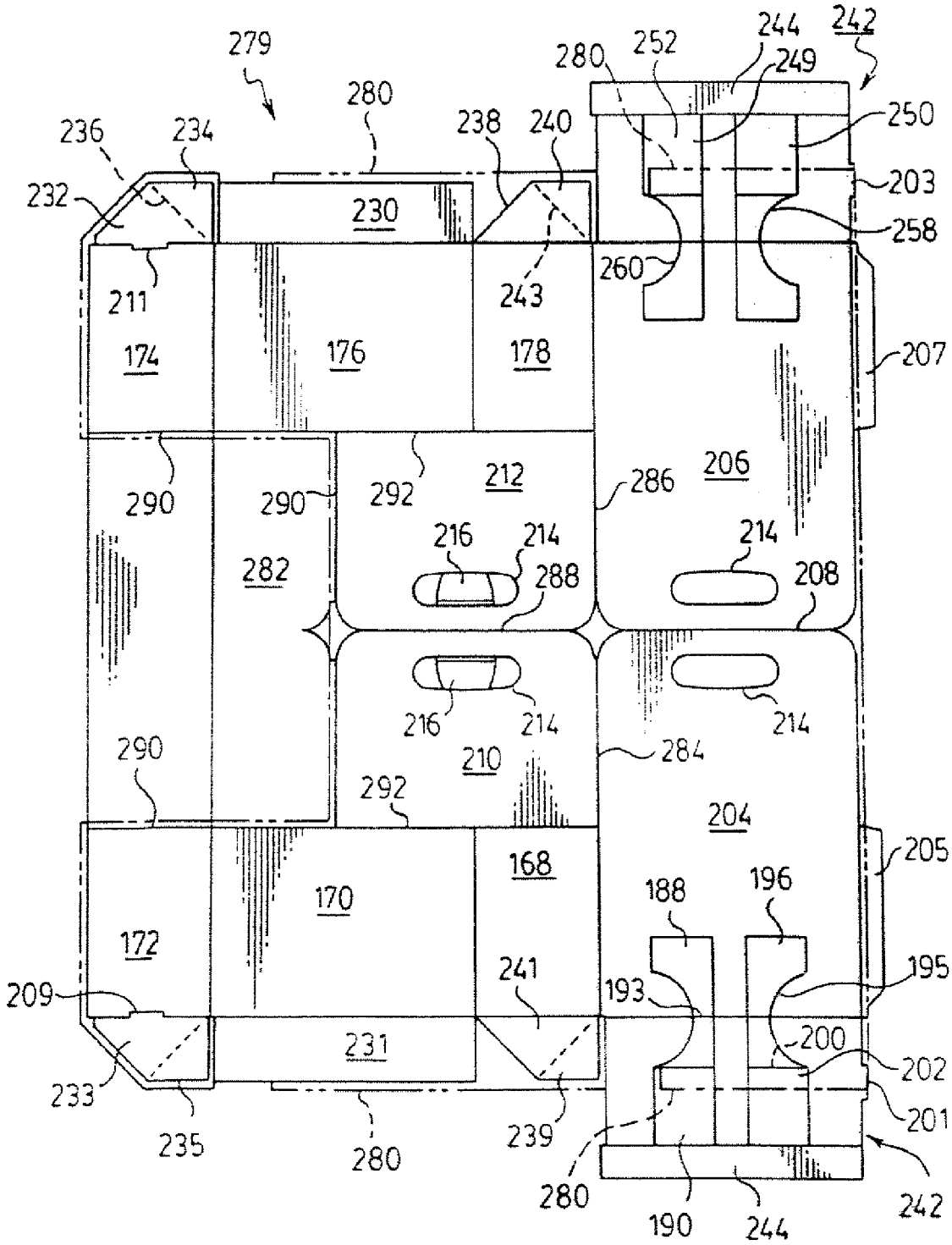
FIG. 23 is a top plan view of a single blank used to make the embodiment of the carrier shown in FIGS. 16-21.

The holding panel structure 186 for the receptacle 164 is not shown in FIG. 20 because its parts are the mirror images of the parts shown in FIG. 20. Thus, FIG. 23 shows a broad panel 231, (also, see FIGS. 16 and 21) corner pieces 233 and 241 with end portions 235 and 239, with diagonal fold lines, as well as the transverse support panel 242.

By now it should be apparent that the term "solid" bottom refers to a bottom portion that has no large holes in the areas for supporting containers in contrast to those shown in the embodiments of FIGS. 1-15.

Single Barrier Structure

FIG. 22 is a perspective view showing an alternative embodiment of the invention in which a single divider structure 270 is provided for one of the receptacles 262 of a carrier like that shown in FIG. 16.

The structure has side walls 264, 266 and 268, and the structure 270 has a panel 272 with a fold line 273, and a vertical panel 274 when popped-up. Semi-circular cutouts are provided at 276 and 278 to provide lateral support for containers in either of the two compartments formed by the barrier structure 270.

Although the use of the single pop-up barrier structure or divider 270 in the "up" position commits both compartments to use with side barriers, the single structure 270 shown in FIG. 22 can be advantageous in some uses.

Single Sheet Manufacture

FIG. 23 is a top plan view of a single sheet 279 from which the carrier shown in FIGS. 16 through 21 can be manufactured.

Advantageously, the structure permits all graphic matter on the carrier to be printed by printing only one surface of the sheet 279. FIG. 23, in fact, shows in dashed outline, the recommended bleed boundaries for the printing process at 280.

The upper surface of the sheet 279 is treated by adding an acrylic finish to make it smoother than raw fiberboard, whereas the other side of the sheet is left raw. This gives the upper surface a better appearance, but saves the cost of coating both sides. The acrylic finish also makes the fiberboard stronger and more liquid-resistant.

The vertical panels are shown at 204 and 206, and the fold line between them is shown at 208.

Advertising is printed on each of the surfaces 210 and 212, 168, 170 and 172, 174, 176 and 178, and on each of the panels 204 and 206. Advantageously, this is all done in one printing operation, usually including two to four color separation printing steps, without the extra cost of turning the sheet over to print on the other side.

Separation lines are formed at 290, 292, 288, at the edges of the pop-up barriers, and elsewhere where separation is desired. Fold lines are provided at 208, 284 and 286, at the junctions between the side panels 168, 170, 172, etc., and wherever else folds are to be made.

Then, the sheet 279 is sent to the automatic fabrication equipment in which scrap such as the panel 282 and other unneeded material is removed. The panels 210 and 212 are folded along lines 284 and 286 onto the surfaces of the panels 204 and 206 underneath the ones shown in FIG. 23. Adhesive is applied to the panels 210 and 212 and they are adhered to the panels 204 and 206.

The side wall structures are folded and secured at the left edge to the tab 205 or 207 with adhesive to complete the foldable side wall structure. The corner tab portions 234, 235, 239 and 240 are folded and adhered to the surfaces to which they must adhere, and the side wall structures are folded flat against the central panel structure 162.

It should be noted that the side walls of the carrier shown in FIG. 16 are somewhat higher than the side walls of other carriers shown above in this patent application. Although the height of the side walls can be varied as needed, if the objects stored in the receptacles do not reach the tops of the receptacles, a tray that is slipped over the panel structure 162 as indicated at 70 in FIG. 16 is likely assured of a flat, even supporting edge on which to rest; namely, the upper edges of the side panels.

Of course, the height of the side walls can be adapted to the needs of a particular usage for the carrier.

Six-Pack Carrier

Figure 24:
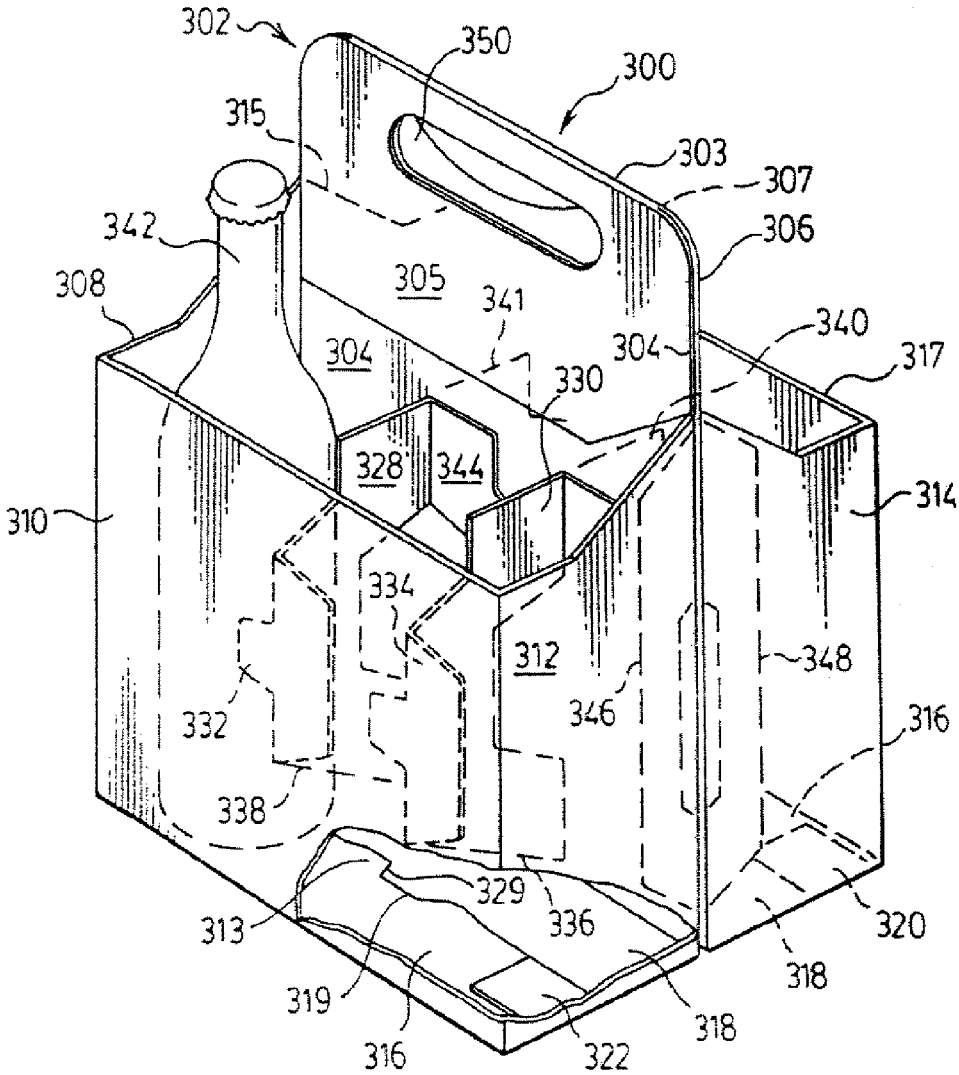
FIG. 24 is a perspective view, partially broken away, of another embodiment of the carrier of the present invention.
Figure 25:
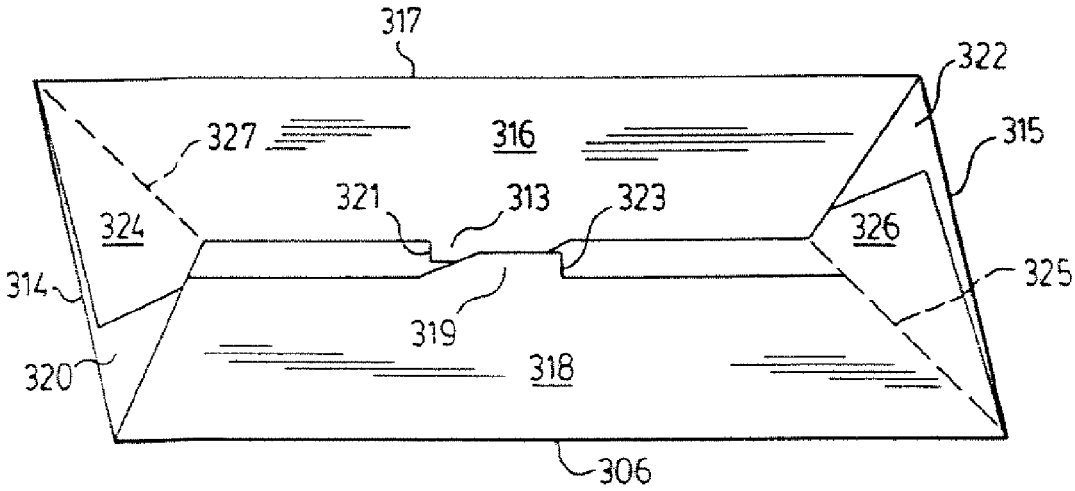
FIG. 25 is a bottom plan view of a partially unfolded bottom structure for one of the receptacles of the carrier shown in FIG. 24.
Figure 30:
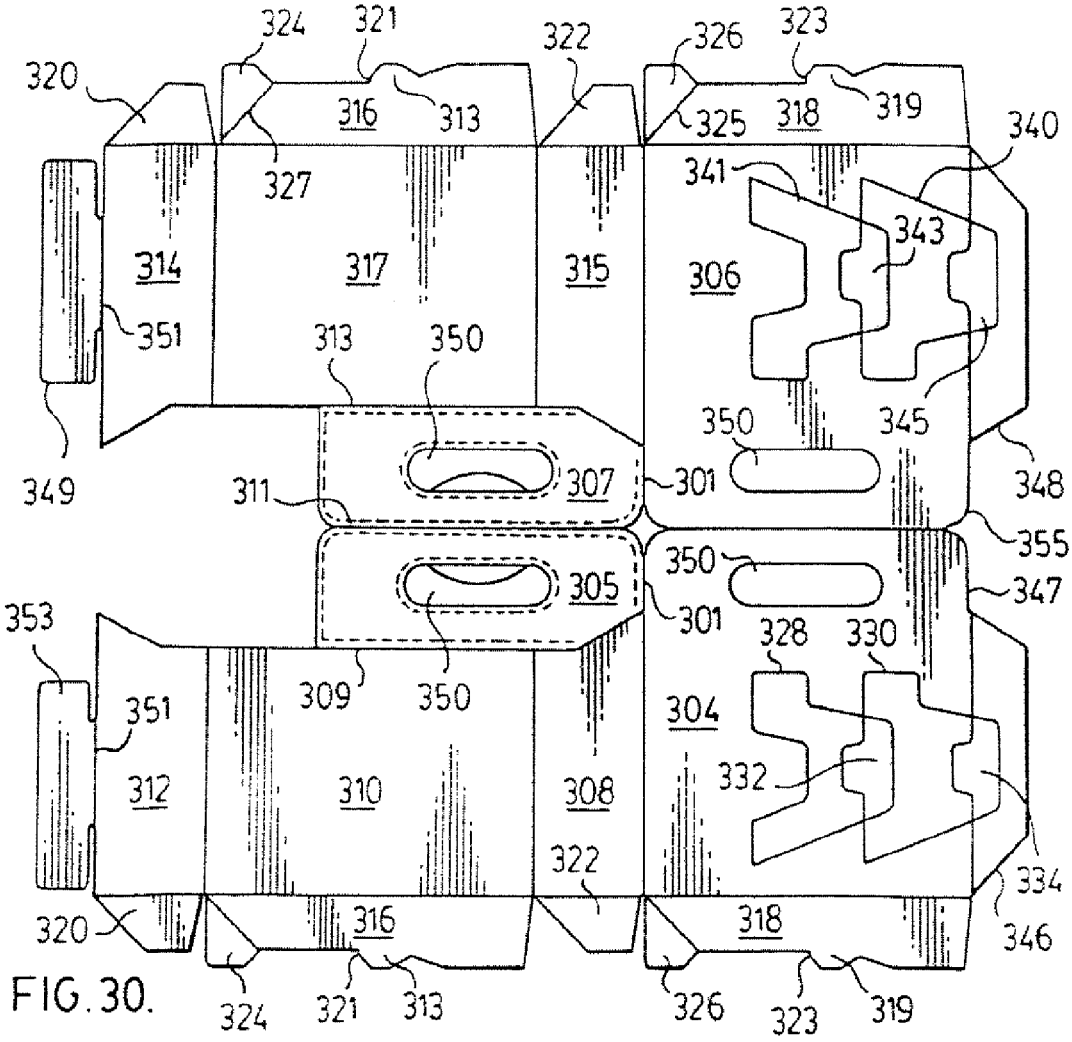
FIG. 30 is a top plan view of a blank used to form the carrier shown in FIG. 24.

Although the carrier structures described above can be used to carry six bottles or cans of liquids such as beverages, FIGS. 24, 25 and 30 of the drawings show a preferred construction which can be used to make a dedicated six-pack carrier.

FIG. 24 shows a carrier 300 similar to the carriers described above, but dedicated to carrying six bottles or cans or other similarly shaped objects. The carrier 300 consists of a central support structure 302 comprising two panels 304 and 306 formed by folding a single panel along a line 303 which forms the upper edge of the central support structure 302. A handle hole 350 is provided in the upper portion of the structure 302. The upper portion of each panel 304 and 306 is strengthened by an overlay panel 305 or 307. Panels 305 and 307 are separated from the blank shown in FIG. 30 along lines 309, 311 and 313, folded along a line 301, and secured to the panel 304 or 306 by adhesive.

As in the other carriers described herein, a foldable receptacle is provided extending from the lower portion of each of the panels 304 and 306.

Referring again to FIG. 24, one receptacle includes side walls 308, 310 and 312, as well as a bottom structure and foldable dividers 328 and 330 to divide the receptacle into three compartments, each of which is designed to hold a bottle such as the bottle 342 or a can or other similarly shaped object.

The second receptacle has side wall panels 314, 317 and 315 (see FIGS. 30 and 25 as well as FIG. 24), and has two fixed dividers 340 and 341 dividing that receptacle into three bottle or can-receiving compartments, and a bottom structure like that of the first receptacle.

The side wall 314 is secured to the panel 306 by gluing it to a flap 348 which extends from the side of the panel 306. Similarly, the side wall panel 312 is glued to the panel 304 by means of a flap 346 extending from the side of the panel 304. Flaps 349 and 353 (see FIG. 30-*not* shown in FIG. 24) extending, respectively, from panels 314 and 312, wrap around the edge 347 or 355 (FIG. 30) and are fastened with adhesive to the inside surface of panel 304 or 306 to reinforce those edges.

The bottom construction for the second of the two receptacles is illustrated in FIG. 25, which shows the bottom of the receptacle when it is almost unfolded.

A pair of long flanges 316 and 318 extend, respectively, from the outside side wall panel 317 and the central panel 306. (See FIGS. 25 and 30.)

Other relatively short flanges 320 and 322 extend, respectively, from the shorter side walls 314 and 315 of the receptacle. Each of the long flanges 316 or 318 has a tab or flap 324 or 326 at one end which is secured with adhesive to one of the flanges 320 or 322, as shown in FIG. 25. Fold lines are provided at 325 and 327, and the bottom structure shown in FIG. 25 is partially folded inwardly along those fold lines.

The bottom structure of the first receptacle is the same as that of the second receptacle, and has been given the same reference numerals.

As it is shown in FIGS. 25 and 30, each of the flanges 316 and 318 has a projection 313 or 319 with a lateral edge 321 or 323. When the receptacle is fully unfolded and the bottom structure is pressed downwardly (as it will be under the weight of a bottle or can), the projections 313 and 319 overlap the other flange 316 and 318, and the lateral edges 321 and 323 abut against one another as shown at 329 in FIG. 24 to prevent the resiliency of the folded carrier material from causing the receptacle to close. This holds the receptacles open while they are being loaded, and the overlap of the flanges 316 and 318 and their projections strengthens the bottom structure.

Of course, other structures shown elsewhere herein also can be used to hold the receptacles open.

The dividers 328, 330, 340 and 341, are formed as cutouts from the panels 304 and 306, as it is apparent form FIGS. 30 and 24. This leaves holes such as the hole 344 shown in FIG. 24. This does not diminish the carrier capabilities of the device, but has the advantage of using only one die-cut blank, and of insuring minimum weight of the carrier by not having to add additional material constituting the dividers. Each of the dividers 328, 330, 340, etc., is attached integrally to the panel 304 or 306 at one end, and has a folded flap 332, 334, 343 or 345 which is adhesively secured to the long side wall 310 or 317 of the receptacles.

Advantageously, the bottom edges 336, 338 of the dividers are spaced upwardly from the bottom of the vertical panels so as to give clearance for the flanges 318 to rotate downwardly from the folded-up position to a horizontal position when the carrier is unfolded.

The carrier shown in FIGS. 24 and 25 is believed to be particularly advantageous for high speed, high volume production line manufacturing, in that it can be formed from a single blank, has a relatively small number of glue-points, and can be printed on one side without having to turn the blank over to print the other side.

The glue points in the embodiment shown in FIGS. 24, 25 and 30 are at flaps 332, 334, 343 and 345, flaps 346, 348, 349 and 353, and flaps 326 and 324. Additionally, the panels 305 and 307 are glued onto the panels 304 and 306, respectively.

Large Two-Cup Carrier

Figure 31:
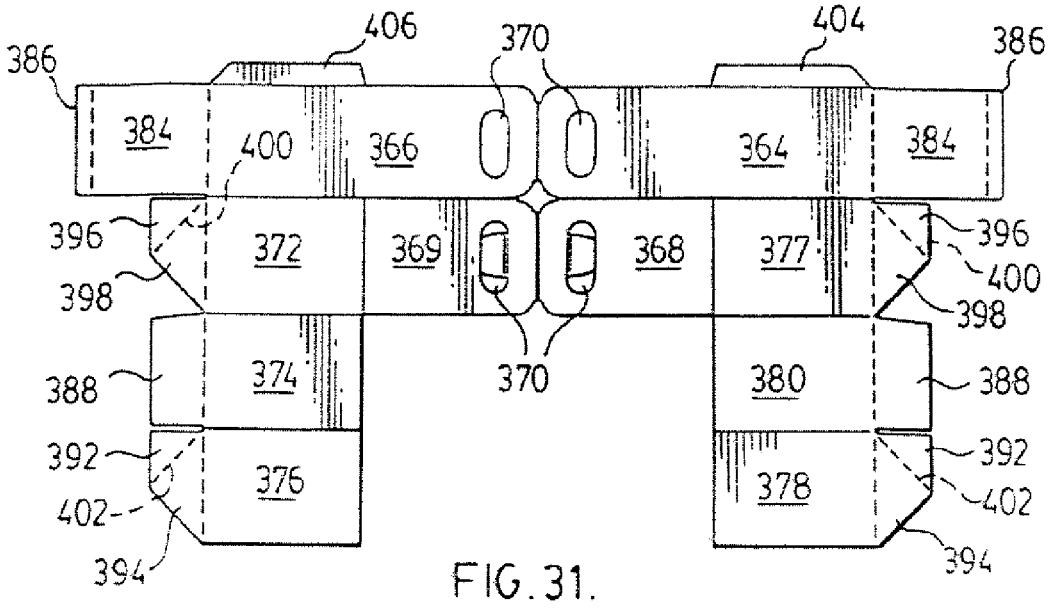
FIG. 31 is a top plan view of a blank used to form the carrier of FIG. 26.

FIGS. 26, 27 and 31 show a carrier 360 which is specifically designed to carry two relatively large cups 382 of a beverage, such as 48 ounce beer cups. It is particularly advantageous for use in ball parks or other stadiums in which customers are limited to purchasing two beers at a time. However, the carrier also can be used for carrying other large relatively heavy objects (e.g., two large potted plants, etc.)

The carrier 360 includes a central support structure 362 consisting of a panel folded at edge 367 to form vertical panels 364 and 366. Panels 368 and 369 (also see FIG. 31) are separated, folded over and glued onto the upper portions of panels 364 and 366, for reinforcement purposes, as in other carriers described above.

Two receptacles are formed by side wall panels 372, 374 and 376, and 378, 380 and 377 which are adhesively secured to the panels 364, 366 by flaps 404 and 406, respectively.

FIG. 27 shows the nearly unfolded bottom structure of the receptacle formed by walls 378, 380 and 377. The construction is similar to the bottom structures described above, except that the bottom of each receptacle is approximately square when fully unfolded. The bottom structure of the other receptacle is the same and is given the same reference numerals.

The bottom structure consists of four flanges 384, 388, 394 and 398, with the flanges being secured together at opposing corners 392 and 396 of the bottom structure. One end of each of the flanges 394 and 398 is trimmed diagonally, and fold lines are provided at 400 and 402. The bottom structure is partially folded along those lines as shown in FIG. 27.

The flange 384 is larger than the other flanges, and extends outwardly far enough to completely cover the bottom and engage the opposite side wall (and, optionally, the other side walls) of the receptacle so that it spans and covers the entire bottom of the receptacle. An upturned flanged edge 386 helps grip the inner wall against which it bears so as to help hold the flange 384 down while objects are being placed in the receptacles.

A relatively short hand or finger hole 370 is provided near the top of the center support structure 362. The sides of the hole 370 advantageously extend relatively close to the side edges of the relatively narrow central support structure.

FIG. 28 is a side elevation view which shows the carrier 360 in use with an auxiliary tray 408 which has a slot in the bottom like that shown in FIGS. 1 and 6 above, and the tray is slipped on to the carrier 360 by inserting the top of the center support structure 362 through the slot. This allows solid foods or additional beverages such as soup containers etc., to be placed in the tray which can rest on the tops of the large containers 382. This serves the same purpose as similar trays shown in the embodiments described above.

FIG. 29 shows a further embodiment of the invention in which two of the carriers 360 are arranged side-by-side and fitted into a special auxiliary tray 410 with a wide slot large enough to allow two of the central support structures 362 to pass through side-by-side. The auxiliary tray 410 thus secures the two carriers 360 side-by-side to one another. The holes 370 are close enough to one another so that a single hand of an adult can grip both hand holes simultaneously, thus enabling the customer to carry four large beverage cups with one hand.

FIGS. 32, 33 and 34 illustrate another version of the two-compartment carrier 360 shown in FIGS. 26, 27 and 31. The carrier is the same as the carrier shown in those Figures except for the bottom construction. Therefore, the components are given the same reference numerals as in FIGS. 26, 27 and 31, with the exception of the components of the bottom construction.

FIG. 32 is a broken away view illustrating the bottom construction for one of the two compartments of the carrier. The bottom wall has four flanges or flaps 424, 428, 430 and 434 with glue flaps 427 and 432 (FIG. 34) which are overlaid atop one another and edge-to-edge when the carrier is completely unfolded. In FIG. 32, the flaps are shown in a position just prior to becoming completely flattened.

FIG. 33 is a bottom elevation view similar to FIG. 27, showing a partially unfolded bottom construction of the compartment opposite the one whose bottom is shown in FIG. 32. The bottom constructions of the two compartments are the same.

The bottom construction shown in FIG. 33 includes a flange or flap 412 extending from the right end of the side panel 377 (see FIG. 34); a flange 416 extending from the right end of side wall panel 364; a flange 422 extending from the right side of side wall panel 380; and a flange 418 extending from the end of side wall panel 378. Each of flanges 416 and 422 has a tab 414 or 420, respectively, extending from one edge of the flange and with a fold line 424 or 426 (see FIG. 33).

The tab 414 is glued to the flange 412, and the tab 420 is glued to the flange 418, as shown in FIG. 33.

When the carrier is completely folded, the flanges fold up flat along the fold lines 424 and 426, as well as the fold lines between each of the flanges and the side wall panel which it extends from.

The flanges are shaped and dimensioned so that they just clear one another as the carrier is being unfolded, or slightly interfere with one another. Then, when the bottom is completely unfolded, the edges of the panels abut against one another to make a tight-fitting bottom panel construction, as shown in FIG. 32.

The bottom construction shown in FIGS. 32, 33 and 34 is believed to be stronger and more able to sustain heavy loads than the bottom construction shown in FIGS. 26, 27 and 31.

Four-Compartment Fixed-Divider Carrier

Figure 35:
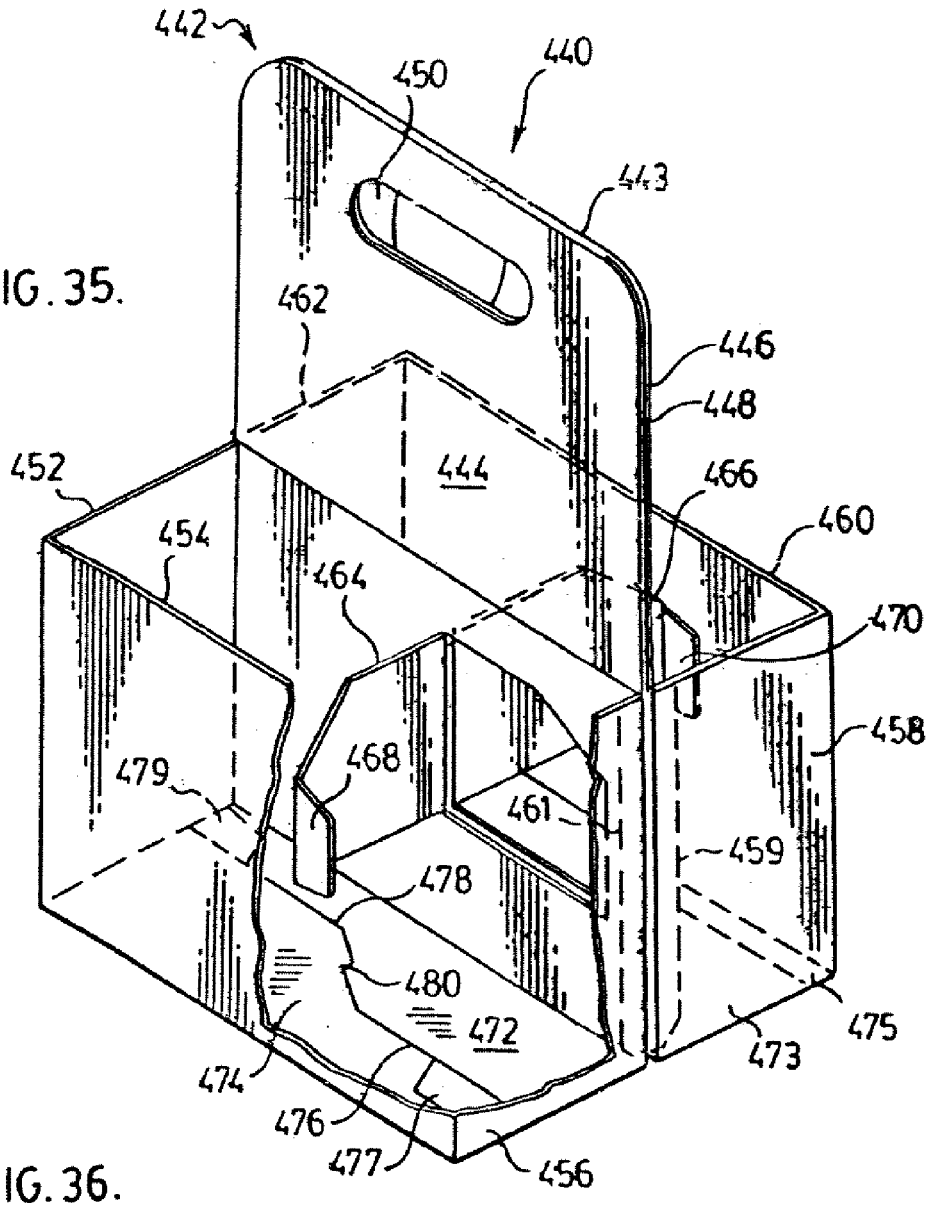
FIG. 35 is a perspective view, partially broken away, of another carrier of the invention.
Figure 36:
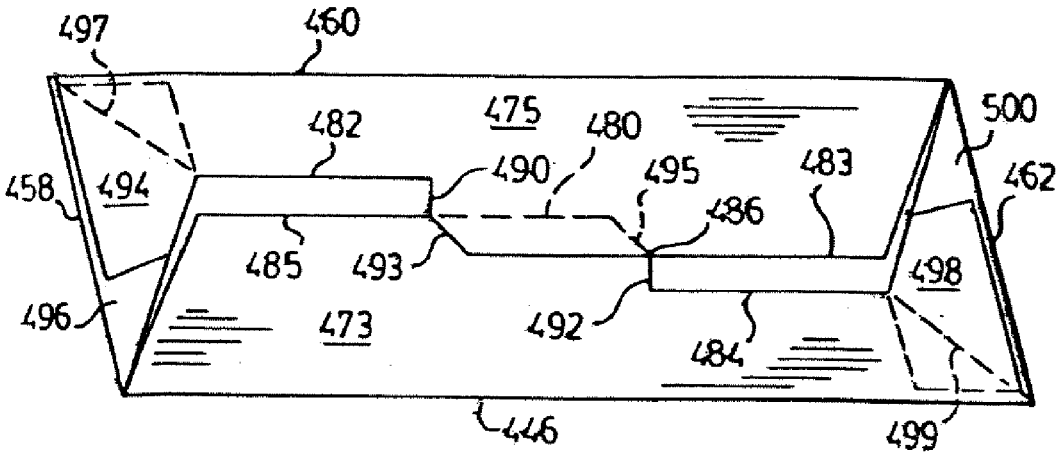
FIG. 36 is a bottom plan view of one of the compartments of the carrier shown in FIG. 35.
Figure 39:
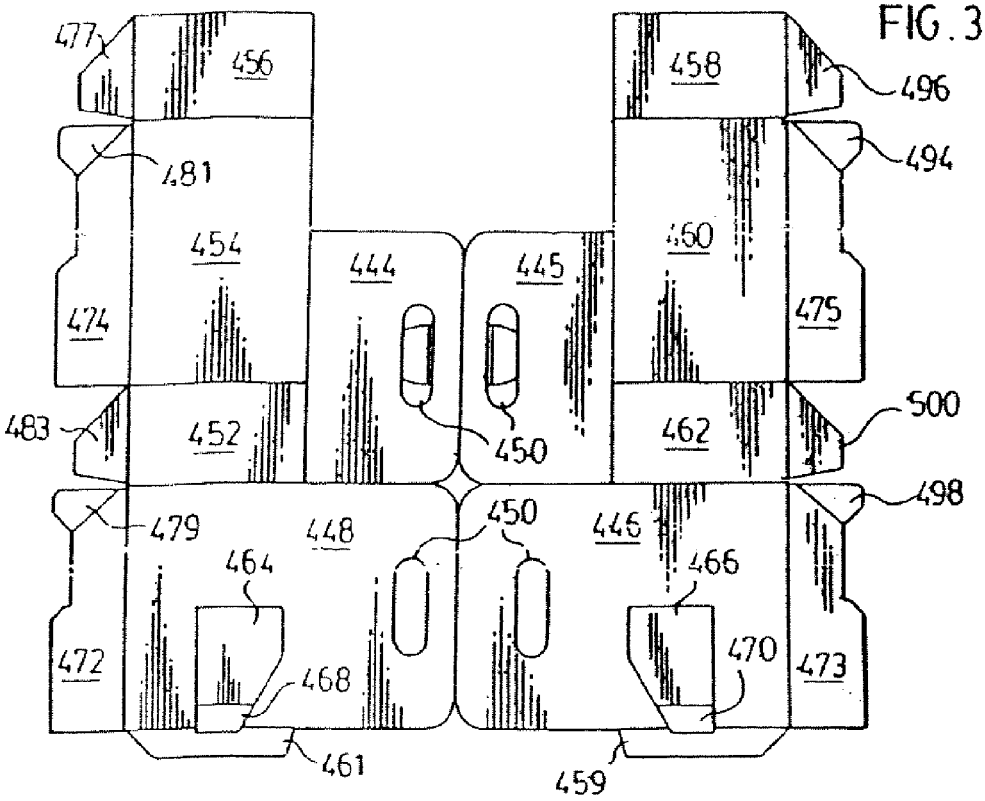
FIG. 39 is a top plan view of the blank used to make the carrier shown in FIG. 35.

FIG. 35 shows another carrier 440 constructed in accordance with the present invention. FIG. 36 is a bottom plan view of one of the two receptacles of the carrier, and FIG. 39 is a top plan view of the blank used to make the carrier 440.

The carrier 440 includes a central support structure 442 consisting of a panel folded at the middle forming the top edge 443 of the carrier and forming two vertical panels 446 and 448. Panels 444 and 445 (see FIG. 39) are glued onto the panels 448 and 446 respectively, as in the embodiments described above. A hand hole 450 is formed in the central support structure. Two opposite receptacles are formed and extend outwardly from the panels 446 and 448. Each compartment is divided by a divider structure into two separate receptacles.

One receptacle consists of side walls 452, 454 and 456 folded over to form a rectangular side wall structure and glued to the central panel 448 by means of a flap 461.

Similarly, the other large compartment is formed by side walls 458, 460 and 462 folded over and secured to the panel 446 by means of a flap 459 which is glued onto the wall 458. Two dividers 464 and 466 are provided. They are formed as cut-outs from the panels 448 and 446, respectively. Each has an end flap 468 or 470, respectively, which is glued to the long side wall 454 or 460. This effectively divides the receptacle into two smaller compartments.

The bottom construction is similar in some respects to that of the carrier shown in FIGS. 24, 25 and 30. Each of the two receptacles has a long flange 472 or 473 extending from the panel 448 or 446. An opposing long flange 474 or 475 extends from the outer side wall of each compartment. The long flange 472 has a wide portion 476 and a narrower portion, and each of the outer panels 474 and 475 has a wider portion 478, etc. Each of the long flanges has a lateral edge located at the transverse center line of the flange. These edges abut against one another when the carrier is fully unfolded, as shown at 480 in FIG. 35, and as will be described in greater detail below.

FIG. 36 is a bottom plan view of the bottom of the compartment formed by the walls 458, 460 and 462 in FIG. 35. The bottom is shown nearly unfolded, as in similar views of carriers described above. The flange 475 has an end tab 494, and flange 473 has an end tab 498.

A flange 496 extending from the side wall 458 and a flange 500 extending from the side wall 462 are glued, respectively, to the tabs 494 and 498 with fold lines at 497 and 499, respectively. Similarly, flanges 472 and 474 have end tabs 479 and 481 which are glued to flanges 483 and 477.

The section 482 of flange 475 is narrower than the section 483 and a lateral edge is formed at 490 with a beveled corner at 493.

Similarly, the portion 485 of flange 473 is wider than the portion 484, and a lateral edge is formed at 492. The corner is beveled at 495.

When the carrier is fully unfolded, the flanges 473 and 475 are pushed downwardly by the weight of the object placed in the compartment, or by the hand of someone assembling the carrier, and the two lateral edges 492 and 490 of the two flanges 473 and 475 engage one another and lock together to hold the compartment open. The bottom flanges of the other compartment have a corresponding locking structure.

The bottom edges of the two dividers 464 and 466 are located upwardly from the bottom of each compartment so as to give adequate room for the flanges 472 and 474 to swing downwardly to lock together to form the bottom of the carrier when the carrier is unfolded.

Because the opposing long flanges of each of the two compartments of the carrier overlap one another and interlock, the bottom is strong and holds itself open while objects are being loaded into the carrier.

Carrier with Cup-Holding Holes and Tall Sides

Figure 37:
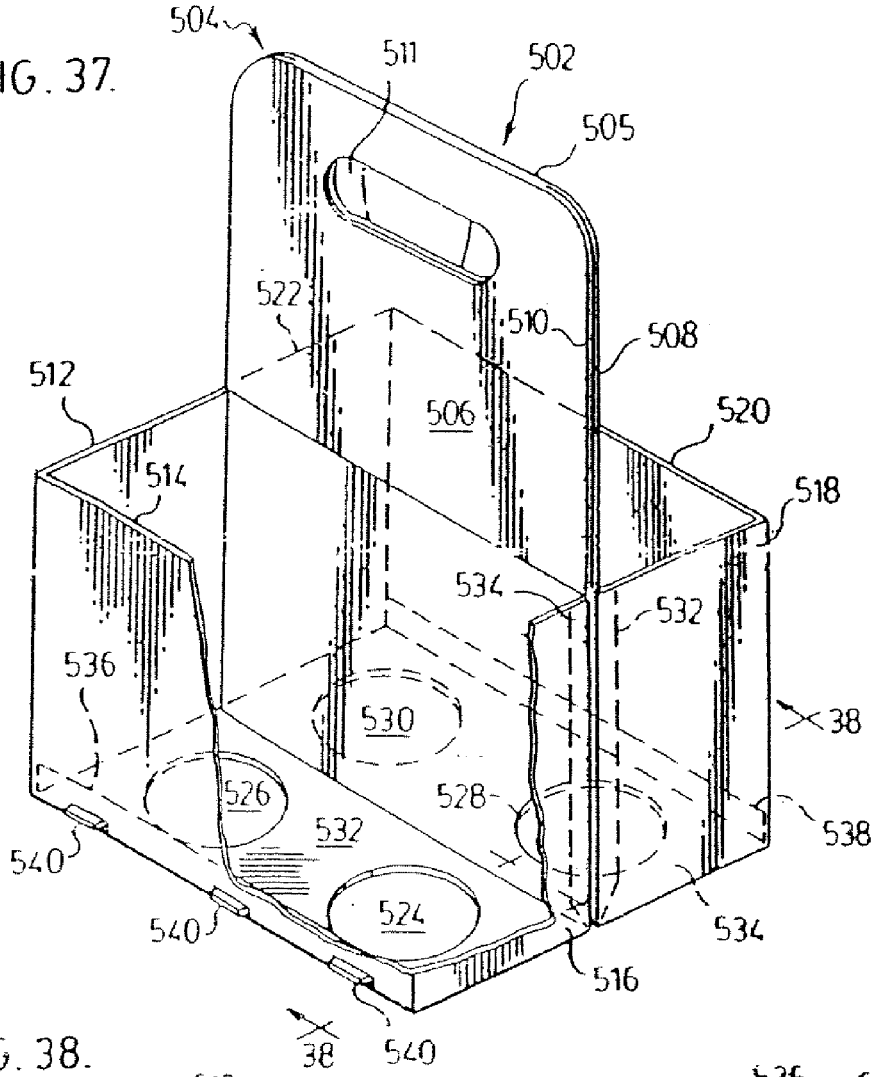
FIG. 37 is a perspective, partially broken away view of another carrier of the invention.

FIG. 37 shows another carrier 502 of the invention. It has cup-holding holes in the bottom, like the embodiment shown in FIGS. 1 and 2, but has side walls that are relatively tall so as to enable the carrier to hold tall beverage cups with their bottoms stabilized in the cup-receiving holes and their top portions held by the relatively tall side walls.

Figure 38:
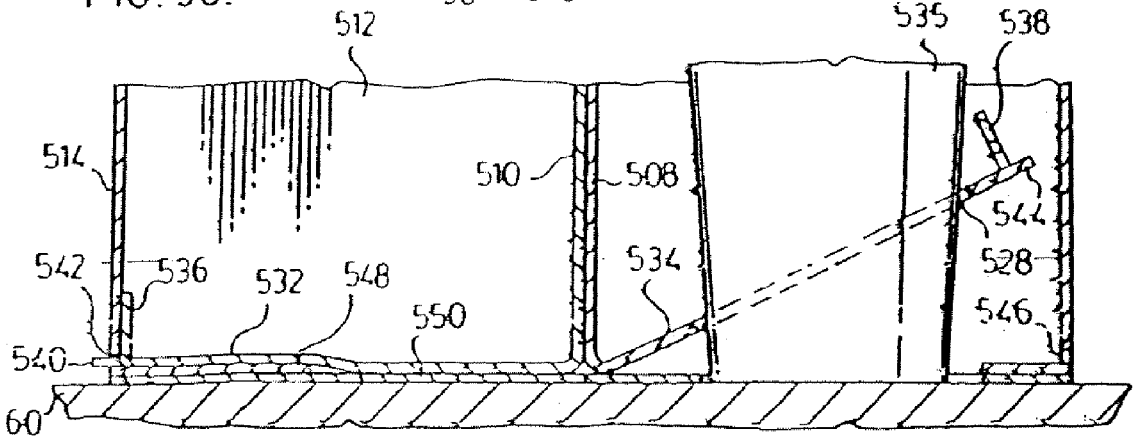
FIG. 38 is a cross-sectional view, partially schematic and partially broken away, taken along line 38-38 of FIG. 37.
Figure 40:
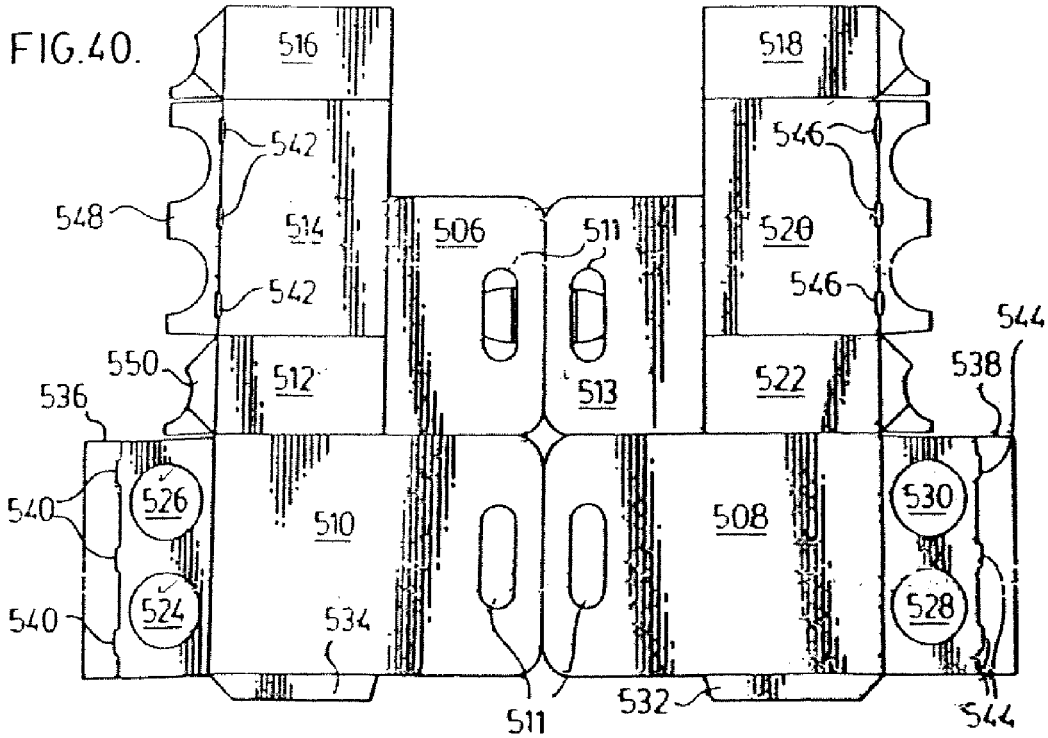
FIG. 40 is a top plan view of the blank used to form the carrier of FIG. 37.

FIG. 38 is a cross-sectional view taken along line 38-38 of FIG. 37, and FIG. 40 is a top plan view of the blank used to form the carrier 502.

The carrier 502 includes a central support structure 504 with a panel folded at 505 to form two vertical panels 508, 510, with a hand hole 511. Panels 506 and 513 (FIG. 40) are glued onto the surfaces of the panels 510 and 508, respectively.

There are two large receptacles in the carrier. One is formed by side walls 512, 514 and 516 glued to a flange 534 extending from the panel 510.

The other receptacle is formed by side wall panels 518, 520 and 522, with a flange 532 extending from the panel 508 and glued to the panel 518.

Each of the bottom walls of the two receptacles has a pair of beverage cup-receiving holes 524, 526 and 528, 530.

Referring now to FIG. 38, the bottom structure includes a bottom panel 550, an intermediate panel 548 and a broad horizontal panel 532 or 534. The broad panel 532 spans the full width of its receptacle. Similarly, the broad panel 534 spans the width of the other receptacle. Each broad panel has an upwardly extending flange 536 or 538 which engages frictionally with the inside of the wall 514 or 520 against which it bears when the carrier is fully unfolded.

Each of the broad panels 532 and 534 has three projections 540 or 544, respectively, which extend outwardly by a short distance to engage with holes 542 and 546 (see FIGS. 38 and 40) and extend through those holes when the panel is fully unfolded. This helps to hold the panels 532 and 534 down.

In FIG. 38, a cup 535 is shown resting on a support surface 60 through the hole 528 with the horizontal panel 534 in its upraised position. This showing is made for comparison purposes with FIG. 2 in which the bottom structure is substantially the same, except for the flanges 536 and 538, the projections 540 and 544, and the receiving holes 542 and 546. In other respects, the construction of the bottom of the carrier 502 is substantially the same as that shown in FIGS. 1 and 2 and will not be described further here.

In addition to the advantages described above for the carrier 502, the projections 540 and their receiving holes improve the ability of the panels 532 and 534 to stay down after being unfolded and the projections fitted into the holes, thus facilitating loading of the carrier.

The materials of which the carrier of the present invention can be made need not be expensive. Ordinary, medium weight fiberboard is believed to be sufficient for most purposes. For example, it can be 0.20 S.U.S. recycled newspaper material. If waterproofing beyond the acrylic coating is necessary, a further waterproof coating can be applied on both the inside and outside surfaces.

It is within the realm of the invention also to make the carriers out of flexible plastic materials.

If desired, the carriers can be made of plastic materials that are easily washable so that the carriers can be reused.

The invention, in its various embodiments, well satisfies the objectives set forth above. The carrier is easy and quick to unfold, stands upright on its own to allow the service worker maximum utilization of his or her hands to load food and/or beverages into the carrier, and provides a solid, strong, safe carrying means for both liquid and solid foods. Moreover, the invention provides a relatively large amount of exterior advertising space.

The carrier of the invention also is relatively inexpensive to make, in that it can be made from a single sheet of material, has a relatively low number of glue-points, and bears all the printing on one side of the blank.

In the solid-bottom version of the invention, a variety of different types of beverage or other containers can be carried, both cylindrical containers and tapered containers. Solid objects can be carried next to containers of liquid, or in the auxiliary tray attachable to the carrier.

The invention also is advantageous in that the central support panel structure is formed of hinged-together panels which are printed on the inside facing surfaces so that additional advertising displays can be placed on those surfaces.

The solid-bottomed embodiments can be used for carrying beverages, such as soft drinks, beer, hot or iced tea or coffee, hot soup, and many other objects other than food, such as blood or other fluids in hospitals, flower pots, cans of oil or fuel additives for automobiles or motorcycles, and, in general, a wide variety of objects which will fit into the carrier.

It should be understood that when the term "food" is used in the claims of this patent application, unless otherwise stated, the term includes all forms of food including liquid, solid, granular, and other forms.

The above description of the invention is intended to be illustrative and not limiting. Various changes or modifications in the embodiments described may occur to those skilled in the art. These can be made without departing from the spirit or scope of the invention.

What is claimed is:

1. A carrier comprising:

a central support structure having a pair of vertical support panels and a handle structure;

a pair of foldable side wall structures each extending outwardly from one of said vertical support panels when unfolded to form a side wall for a retainer structure;

each of said side wall structures comprising a plurality of panels attached together and to said support structure along vertical fold lines, each of said side wall panels having an upper edge and a lower edge, said side wall panels including one panel spaced from and opposing said central support structure;

each of said vertical panels and said side wall panels having a foldable flange extending outwardly from the lower edge thereof, each of said flanges overlapping and being secured to another flange to form a separate automatically-unfolding bottom support structure for each of said retainer structures when said side wall structures are unfolded, at least one foldable divider wall having two ends and extending between and secured to said central support structure at one of said ends, and to said one panel at the other of said ends.

2. A carrier as in claim 1 in which each of said side wall structures includes four walls, each having a flange extending from its bottom edge, each of said flanges being secured to an adjacent flange with a diagonal fold line to permit folding of said flanges, to provide support for said flanges to form a bottom for said retainer structure.

3. A carrier as in claim 1 in which said central support structure comprises a panel folded to form two panels with the fold line forming the upper edge of said central support structure, each of said retainer structures extending outwardly from one of said panels of said support structure.

4. A carrier as in claim 1 in which said divider wall has an upper edge and a lower edge, said lower edge being spaced upwardly from the lower edges of said side wall panels to permit downward unfolding of said flanges.

5. A carrier as in claim 1 in which each of said divider walls is formed as a hinged cut-out from one of said central support structure panels.

6. A carrier as in claim 1 in which at least one of said flanges has a lateral edge positioned to contact another surface to hold said side walls in the unfolded position and deter said carrier from returning to its folded position.

7. A carrier as in claim 6 in which said other surface is a lateral edge on the other of said flanges.

8. A carrier as in claim 7 in which each of said flanges has a projection which has said lateral edge so that when said flanges are unfolded said lateral edges engage one another to hold said side walls in the unfolded position.

9. A folding carrier, said carrier having a carrying support structure with a handle structure and a pair of folding receptacles secured to and extending outwardly from said support structure when said receptacles are unfolded, each of said receptacles having a foldable side wall structure including a plurality of side walls joined together and to said support structure along fold lines, each of said side walls and said support structure having an upper edge and a lower edge, said side walls forming corners at said fold lines, and a separate bottom structure for each of said receptacles, said bottom structure being formed by foldable flanges extending from said lower edge of each of said side walls and said support structure adjacent ones of said flanges being secured to one another at each of two opposite ones of said corners.

10. A carrier as in claim 9 including a diagonal fold line for one of said flanges at each of said corners.

11. A carrier as in claim 9 including a least one divider in each of said receptacles, said divider being secured at one end to one of said side walls, and at the other end to said support structure.

12. A folding carrier, said carrier having a central support structure with a pair of opposed receptacles extending from opposite sides of said central support structure, each of said receptacles having:

a foldable side wall structure having a plurality of side walls joined together along fold lines to form a foldable enclosure, said support structure forming one of said side walls, each of said side walls having an upper edge and a lower edge and corners at said fold lines;

a bottom structure formed by foldable flanges extending from said lower edge of at least two adjacent ones of said side walls, said flanges being secured to one another adjacent one of said corners;

including a diagonal fold line for at least one of said flanges adjacent said one corner; and in which said foldable enclosure has a generally rectangular shape with four opposed corners, said bottom structure including two other flanges extending from others of said side walls and secured together at another corner opposite said one corner, and including a diagonal fold line in one of said other flanges adjacent said other corner.

* * * * *